US007124716B2

(12) United States Patent
Novotny

(10) Patent No.: US 7,124,716 B2
(45) Date of Patent: Oct. 24, 2006

(54) INTERNAL COMBUSTION ENGINE USING OPPOSED PISTONS

(75) Inventor: Rudolph J. Novotny, Stuart, FL (US)

(73) Assignee: Mechanical Innovation, Inc., Stuart, FL (US)

( * ) Notice: Subject to any disclaimer, the term of this patent is extended or adjusted under 35 U.S.C. 154(b) by 0 days.

(21) Appl. No.: 10/868,098

(22) Filed: Jun. 15, 2004

(65) Prior Publication Data

US 2005/0081805 A1 Apr. 21, 2005

Related U.S. Application Data

(63) Continuation of application No. PCT/US02/31438, filed on Oct. 2, 2002.

(60) Provisional application No. 60/341,781, filed on Dec. 18, 2001.

(51) Int. Cl.
*F02B 75/28* (2006.01)

(52) U.S. Cl. ..... 123/56.9

(58) Field of Classification Search ..... 123/51 R, 123/51 A, 51 BD, 51 B, 56.1–56.9, 42, 55.6, 123/55.7, 47 R See application file for complete search history.

(56) References Cited

U.S. PATENT DOCUMENTS

| | | | | | |
|---|---|---|---|---|---|
| 844,836 | A | * | 2/1907 | Treen | 123/58.1 |
| 1,126,713 | A | * | 2/1915 | Crew | 123/51 B |
| 1,624,952 | A | * | 4/1927 | Jackson | 123/51 R |
| 1,788,140 | A | | 1/1931 | Woolson | |
| 2,076,334 | A | | 4/1937 | Burns | |
| 3,456,630 | A | * | 7/1969 | Karlan | 123/53.6 |
| 3,777,722 | A | | 12/1973 | Lenger | |
| 4,111,104 | A | | 9/1978 | Davidson, Jr. | |
| 4,455,974 | A | | 6/1984 | Shapiro et al. | |
| 4,512,291 | A | * | 4/1985 | Kirk | 123/54.2 |
| 4,681,326 | A | | 7/1987 | Kubo | |
| 4,996,953 | A | * | 3/1991 | Buck | 123/51 A |
| 5,218,933 | A | * | 6/1993 | Ehrlich | 123/55.3 |
| 5,375,567 | A | | 12/1994 | Lowi, Jr. | |
| 5,490,482 | A | * | 2/1996 | Genet | 123/47 R |
| 5,551,383 | A | | 9/1996 | Novotny | |
| 6,079,377 | A | * | 6/2000 | Leijonberg | 123/51 R |

* cited by examiner

*Primary Examiner*—Marguerite McMahon
(74) *Attorney, Agent, or Firm*—Norman Friedland

(57) ABSTRACT

An internal combustion engine having a cylindrical outer housing with inner cylindrical cylinders defining power cylinders circumferentially spaced in the engine. Each of the cylinder(s) has opposed intake and exhaust pistons. The intake and exhaust pistons use air bearings instead of conventional oil as a lubricant. The intake and exhaust pistons power a rotary cam mounted on opposed ends of the engine and a cam follower system positions the pistons. The rotary cam is operatively connected to a drive shaft or power take off shaft. A four bar linkage system is connected to the piston rod to minimize piston side loads. A jumper connects the ends of the power cylinders to pressurize air drawn into the engine and to admit heated air, indirectly heated during the combustion cycle, to charge the power cylinder for improved efficiency and to purge the pressure cylinder after combustion. The overall construction of the engine allows the engine to be made from relatively light weight materials providing a significantly improved power to weight ratio over conventional engines. The overall construction also allows for reduced fuel emissions and greater fuel efficiency.

7 Claims, 20 Drawing Sheets

INTERNAL COMBUSTION ENGINE USING OPPOSED PISTONS

TECHNICAL FIELD

This invention relates to reciprocating internal combustion engines and particularly to an advanced version that eliminates side loadings, utilizes thermally controlled power cylinders, opposed intake and exhaust pistons, piston rings that are cooled and hydrostatically lubricated by air, and incorporates a high temperature cylinder wall which reduces engine emissions and increases engine performance.

BACKGROUND

As is well known, diesel, gas and steam engines of the reciprocating type typically convert the linear piston motion into rotary motion by utilizing piston(s), connecting rod, and crankshaft. This conversion process obviously creates a substantial piston side load which requires oil lubrication to control friction and wear of the piston skirt and cylinder and a substantial and heavy engine case. To prevent oil breakdown and loss of lubricity the cylinder wall and piston side walls and rings generally are maintained at a temperature that is below a maximum of 350 degrees Fahrenheit. Typically, these engines must incorporate a cooling system that serves to reject at least 25 percent of the total heat energy which is dissipated into the ambient air which energy would otherwise provide shaft horsepower.

As will be described in more detail hereinbelow, the engine of the present invention, unlike what is shown in the prior art, floats the piston in the cylinder with a cushion of air by absorbing the side loads that would otherwise load the pistons at locations remote from the piston. Unique to the engine of this invention is the use of air feed tubes made from a compliant material that keep the piston ring concentric to the piston and supply air to the integral piston ring depressions to hydrostatically compress the piston ring relative to the cylinder and continuously float the piston and piston ring on pockets of pressurized air. The engine of the present invention also uses a unique bearing pack connected to a four bar linkage arrangement and cam to transmit power and reduce side loads to the piston. The engine of the present invention also uses a unique jumper system for the purpose of storing base compression air which is pressurized for use in purging the combustion chamber of combusted materials and supply preheated air to the combustion chamber prior to combustion. The engine of the present invention also has a unique power cylinder that distributes heat of combustion along the length of the cylinder to allow higher operating temperatures in the power cylinder.

One of the inventors of the present invention is the inventor of U.S. Pat. No. 5,551,383. This patent discloses the use of an air bearing system that relies upon pressurized air provided by a base compression cylinder that is co-annular to the power cylinder. The '383 patent also employs a four bar linkage system, but the disclosed system is rather complex to replicate in a working engine and doesn't provide the benefits of the unique four bar system of the present invention. The '383 patent also doesn't employ a power cylinder that manages heat to allow higher temperatures to be used in the combustion chamber and power cylinder as does the engine of the present invention. Other improvements are disclosed and claimed in the present application that are not taught or suggested in the '383 patent which are patentable over the '383 patent when considered either individually or in combination with other related technologies.

U.S. Pat. No. 5,375,567 granted to A. Lowi, Jr. on Dec. 27, 1994, discloses a two-stroke-cycle engine that requires no cooling and utilizes twin double-harmonic cams that claim to balance reciprocating and rotary motion at all loads and speeds so as to obviate all side loads. As will be more fully detailed hereinbelow, the present invention makes no claim to the ability of operating without lubrication, Although the engine of the present invention does not require oil as a lubricant for the pistons as is the case for most piston engines it does use air as a lubircant. It also utilizes a four bar linkage system to reduce side loads. Still further, the present invention employs unique seals to seal and absorb the slight side loads that may be encountered by the pistons of the engine.

Other patents that utilize opposing pistons and harmonic types of cams but do not incorporate a linkage system for minimizing or eliminating side loads are U.S. Pat. No. 2,076,334 granted to E. B. Burns on Apr. 6, 1937, and U.S. Pat. No. 1,788,140 granted to L. M. Woolson on Jan. 6, 1931.

Also disclosed in the prior art are a number of patents that utilize a gas for lubrication rather than oil. For example, U.S. Pat. No. 4,455,974 granted to Shapiro et al on Jun. 26, 1984, utilizes gases generated in the engine to hydrostatically support the piston rings. Similarly, U.S. Pat. No. 4,681,326 granted to I. Kubo on Jul. 21, 1987, utilizes engine gasses to support the piston rings. U.S. Pat. No. 4,111,104 granted to Davison, Jr. on Sep. 5, 1978, utilizes engine gases to support the piston and U.S. Pat. No. 3,777,722 granted to K. W. Lenger on Dec. 11, 1973, discloses a ringless piston with air for reducing friction.

BRIEF DESCRIPTION OF THE INVENTION

The present invention provides an improved internal combustion engine that has a low weight to power ratio, low emissions and low fuel consumption. The engine of the present invention provides numerous improvements over known internal combustion engines.

The present invention includes an internal combustion engine having a housing enclosing at least one cylinder with opposed pistons mounted for reciprocation within the cylinder. Opposed power cams are mounted upon a power output shaft. Each of the power cams are operatively connected to a respective one of the opposed pistons. End plates are mounted to the housing and divide the housing into a center section and end sections. At least one cylinder with opposed pistons mounted for reciprocation within the cylinder is mounted within the center section and one each of the opposed power cams is mounted within a respective one of the end sections. The opposed pistons have connecting rods operatively interconnecting the pistons to the cams. The end plates have openings for reciprocal receipt of the connection rods. Unique seals are provided to seal the end sections from the center sections and to seal the cylinders to the end plates. The entire engine of the preferred embodiment is designed to maintain all spring rates at acceptable rates to avoid any inadvertent weakening of connections in the engine.

The power cylinder of the present invention is uniquely designed to distribute heat along the length of the power cylinder to avoid tapering of the cylinder. The power cylinder has a first member defined by a first hollow tube having a predetermined length. The first hollow tube is adapted to receive at least one piston for reciprocal movement within the first hollow tube. The first hollow tube defines a combustion chamber wherein a fuel and air mixture can be introduced compressed and ignited. This first hollow tube has a high thermal expansion coefficient and low conductivity.

A second member is mounted adjacent the first member. The second member has a high thermal expansion coefficient and high conductivity.

A third member is positioned about the first hollow tube adjacent the combustion chamber of the first hollow tube. The third member has a low thermal expansion coefficient and low conductivity.

The first, second and third members interact to reduce tapering of the first member by initially containing through the third member heat within the combustion chamber and reducing expansion of the combustion chamber and thereafter distributing heat developed in the combustion chamber along the first member by directing the heat along the second member to maintain a generally uniform temperature along the length of the first member.

The engine of the present invention also uses a bearing pack that transfers the power generated by the combustion process to a pair of power cams. The bearing pack has a housing, the housing has a top surface and opposed legs extending from the top surface. The legs have facing inner surfaces and outer surfaces. A pair of axles extend out of the facing inner surfaces and a pair of pins extending out of the outer surfaces, the axles and pins are coaxial.

A four bar linkage assembly is connect to the pins and guide wheels are connected to the axles. The guide wheels have a first wheel and a second wheel, the first wheel having a larger diameter than the second wheel. The opposed cams have opposed spaced apart tracks. The first wheel engages one of the tracks and the second wheel engages the other of the tracks.

The pistons of the present invention are also uniquely designed to include facing combustion surfaces with outer perimeters, the outer perimeters of the combustion surfaces each having a profiled surface, the profiled surfaces mate to form a combustion chamber between the piston combustion surfaces. This allows the combustion surface to be generally closed to reduce heat loss from the combustion chamber during combustion.

These and other characteristics of the present invention with its various alternatives and embodiments can be better understood with reference to the following detailed description of the invention when read in conjunction with the accompanying drawings, wherein like reference characters refer to like parts throughout the several views.

DETAILED DESCRIPTION OF THE PREFERRED EMBODIMENT

In its preferred embodiment, the engine of the present invention as described herein is configured with four (4) cylinders and eight (8) pistons and each paired diametrically opposed piston sets are compressing and expanding axisymmetrically, so as to minimize or eliminate unbalance or out of plane loads at any time during the engines operating envelope for providing a relatively vibration free engine. Since each piston set "fires" twice per output shaft revolution, it produces twice the torque at half the shaft RPM. While this invention is described in the preferred embodiment to include specific parameters, it will be appreciated by one skilled in this art that other parameters including the number of pistons and attendant cylinders could be used without departing from the scope of this invention. It will be appreciated that two opposing pistons in a single cylinder will constitute the minimum number of pistons and cylinders, it will also be appreciated that more or less than four (4) cylinders and eight (8) pistons could be used.

Figure 1:
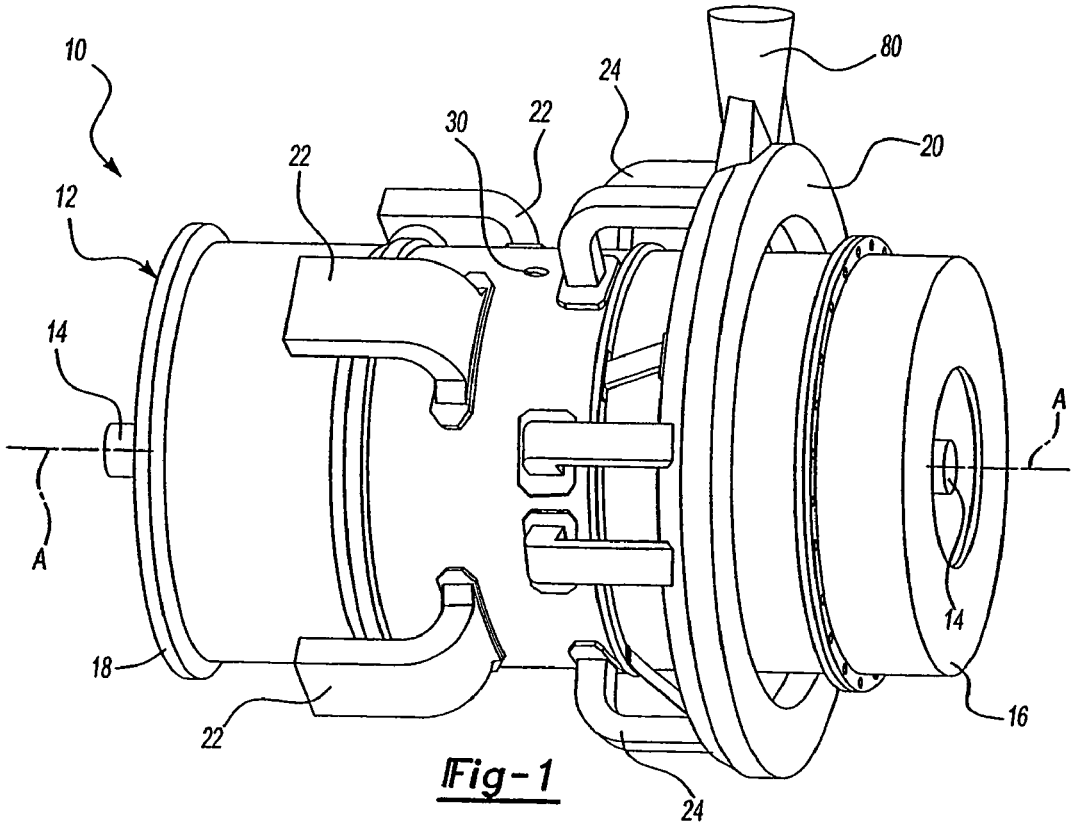
FIG. 1 is a perspective view of the engine of the present invention.

FIG. 1 is a perspective view of the engine of the present invention generally indicated by reference numeral 10 which is comprised of a modular cylindrical engine outer case assembly 12 surrounding the rotary shaft 14 for rotation about the engine's axis A. Shaft 14 extends outwardly from the fore end 16 and the aft end 18. Surrounding the engine outer case 12 is an inlet manifold 20 and exhaust pipes 22 which are in communication with the intake pistons and exhaust pistons. Inlet conduits 24 connect the intake pistons with the manifold 20. In the disclosed embodiment, the exhaust pipes are directly connected to ports adjacent the exhaust pistons. As will be described in greater detail herein below, the inlet port 80 disposed in the inlet manifold 20, which may include a suitable filter, leads fresh ambient air into the piston cylinders. The exhaust ports disposed adjacent the exhaust pipes 22 discharge the spent combusted products to ambient.

Fuel is admitted to the cylinders through the fuel nozzle injectors 30 which is fed fuel under pressure through a fuel line, which is not shown. Fuel from a fuel reservoir is pressurized in a well known manner from suitable injector pump(s). In the preferred embodiment the accessories would be powered by the portion of rotary shaft 14 that extends from the fore end 16 and the power for driving the load would be extracted from the shaft extending from the aft end 18. This is, of course, optional as the power for either the accessories or load may be extracted at either end of rotary shaft 14. It will be understood that the load that the engine drives would include without limitation, passenger cars, land vehicles, aircraft and water vehicle propellers, auxiliary power units, generators, earth moving vehicles and the like.

Figure 2:
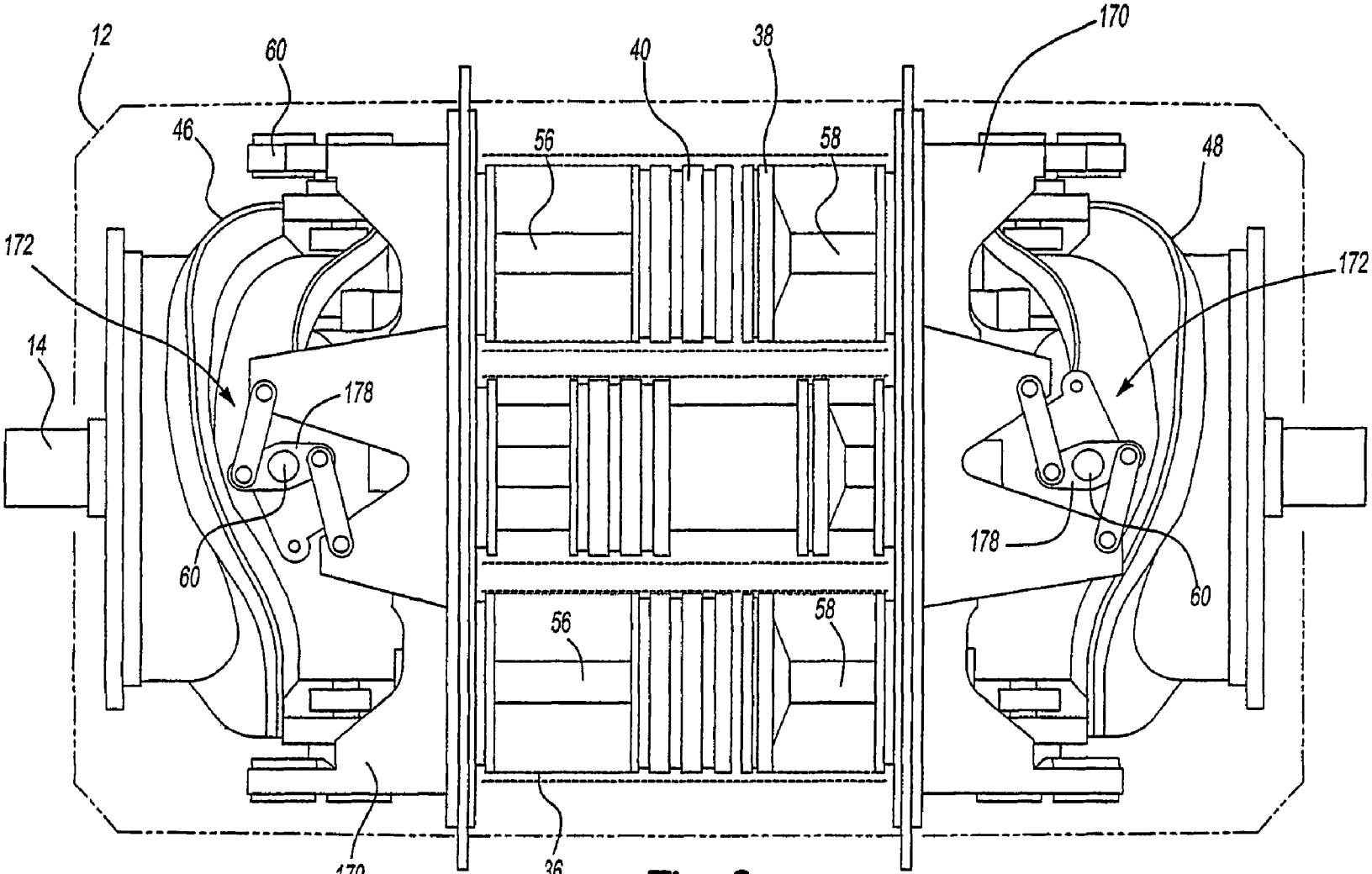
FIG. 2 is a side view of the engine of the present invention with the housing and the power cylinder shown in dotted lines.

With reference to FIG. 2, in the engine as illustrated, there are four equally and circumferentially spaced power cylinder assemblies 36, these are shown by dotted lines in FIG. 2. The construction of the power cylinder assemblies 36 will be discussed in greater detail below. The power cylinder assembly 36 supports (8) pistons, namely four (4) intake pistons 38 opposing (4) exhaust pistons 40.

Figure 3:
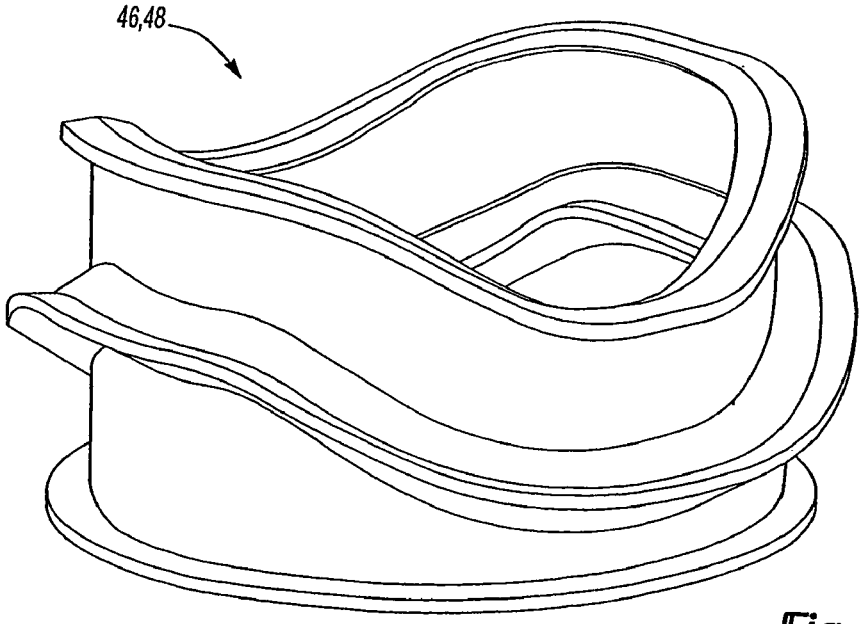
FIG. 3 is a perspective view of the power cam of the present invention.
Figure 4:
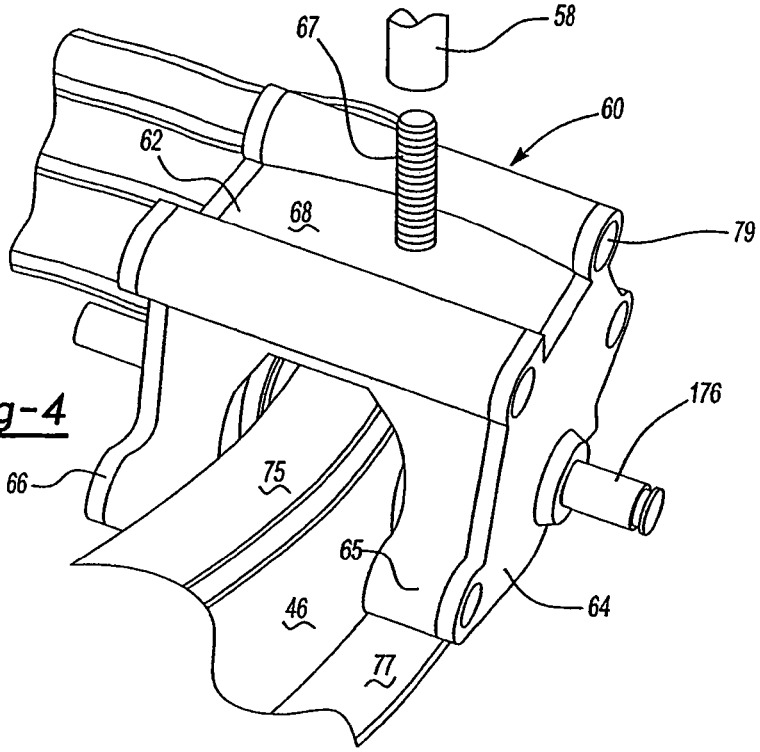
FIG. 4 is a partial perspective view of the bearing pack of the present invention.

Rotary shaft 14 connects to and is rotated by the opposing power cams 46 and 48 (FIGS. 2, 3). In the preferred embodiment, the cams are made of steel and aluminum, but other materials could also be used. The cams 46 and 48 are located concentrically and axially within the engine case 12. Power cams 48 and 46 respectively are driven by the intake pistons 38 and exhaust pistons 40 respectively via the connecting rods 58 and 56, that are operatively connected to respective bearing packs 60. With reference to FIG. 4, the bearing pack 60 includes a housing 62 which is generally U-shaped having side walls 64 and 66, legs 65 and a top 68. In the disclosed embodiment, the top 68 and legs 65 are one piece. The connecting rods 56 and 58 are connected to a respective bearing pack 60 by a machine bolt 67 passing through the top 68 into a threaded nut 69 in rods 56 and 58. In the preferred embodiment, the spring factor of the connection is predetermined to be greater than 3. Still further, in all connections throughout the engine 10 of the present invention, a spring rate of greater than 3 is desired. The spring rate is determined from the following equation:

$$K = \frac{AE}{L}$$

A=area of the respective parts

E=Modulas of elasticity

L=Length of the respective parts.

By way of example, if a bolt and nut are used to connect a stack of material, the spring factor would be determined by the ratio of the spring rate of the stack of the bolt as follows:

$$\frac{K^S}{K^B} > 4 \quad \frac{\left(\frac{A_S E_S}{L_S}\right)}{\left(\frac{A_B E_B}{L_B}\right)} > \frac{4}{1}$$

Figure 5:
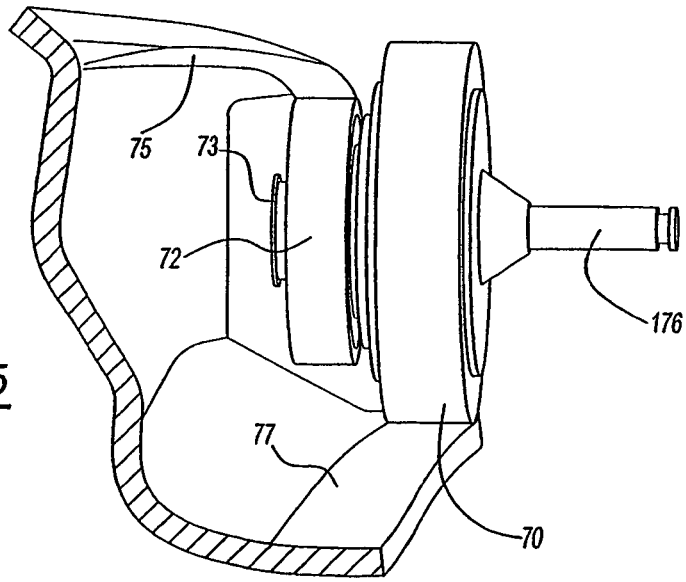
FIG. 5 is a partial cutaway view of the power cam showing the wheels of the bearing pack engaging the opposed walls of the power cam.

The side walls 64 and 66 each receive dual roller bearings 70 and 72 (FIG. 5). Bearing 70 is a power bearing and bearing 72 is a retractor bearing. Bearings 70 and 72 are mounted coaxially on coaxial pins 73 protruding from the inside of each side wall 64 and 66. Pins 176 protrude from the outside of each wall 64 and 66 for connection to the bars of a four bar linkage which will be discussed in greater detail below. The pins 176 are coaxial with pins 73. In this way, a minimal bending moment is created in the operation of bearing pack 60.

Figure 20:
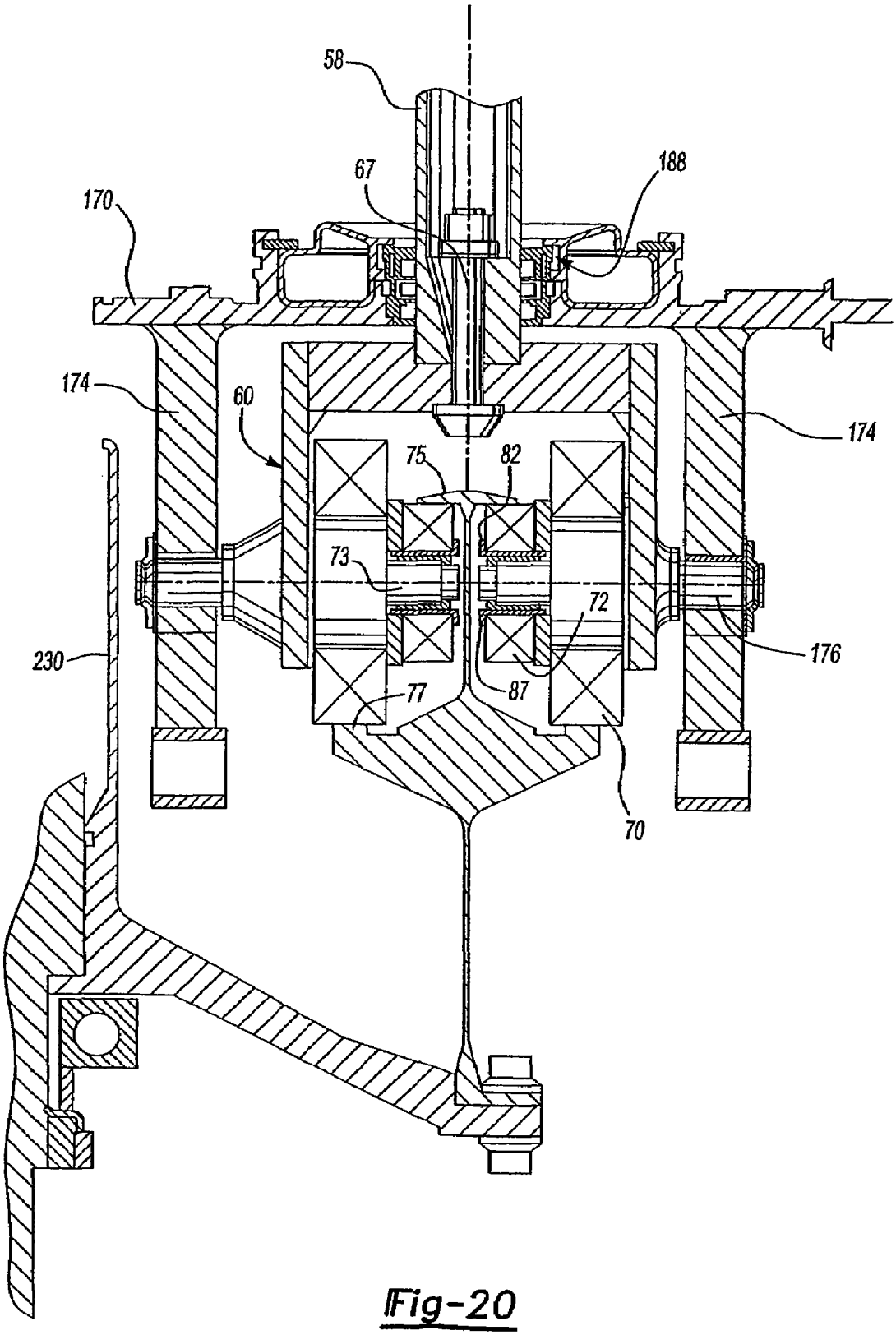
FIG. 20 is a cutaway view of the bearing pack and cam of the present invention.

Each of the bearing packs 60 are operatively mounted to the power cams 46 and 48 as shown in FIGS. 5 and 20. The power cams 46 and 48 have opposed facing tracks 75 and 77 upon which bearings 70 and 72 ride. In the preferred embodiment, the walls 64 or 66 are removably attached to the legs 65 and top 68 by bolts 79. In this way, the side walls with bearings 70 and 72 attached can be assembled with the bearing 70 and 72 between and engaging tracks 75 and 77.

Figure 6:
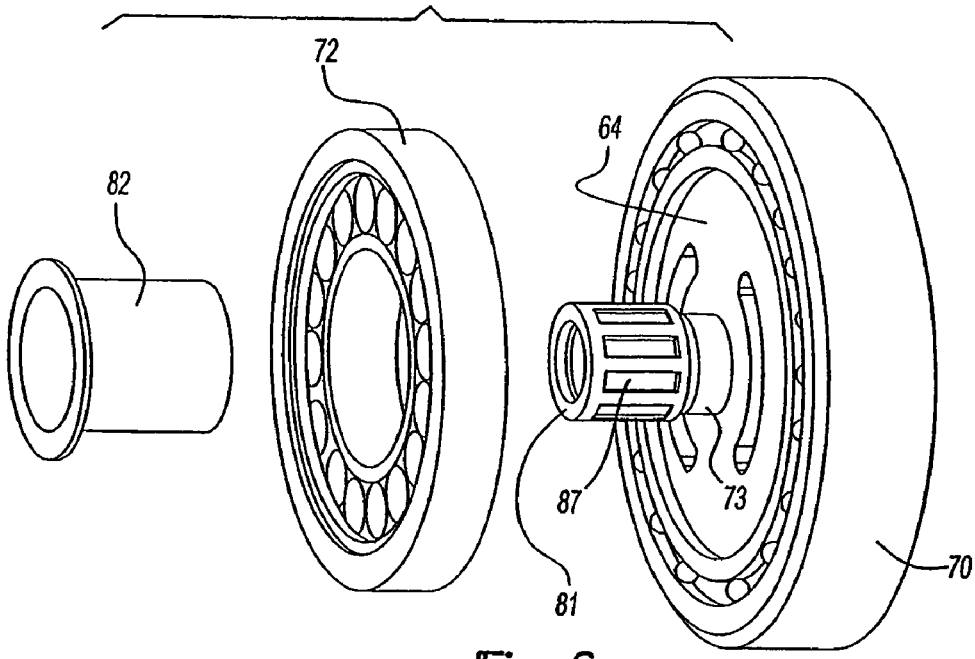
FIG. 6 is an exploded view of the wheels of the bearing pack of the present invention.

In the preferred embodiment, the bearings are preloaded by a retractor preload spring assembly 81 shown in FIG. 6. As illustrated, the power bearing 70 is mounted upon pin 73 and retractor bearing 72 is mounted upon pin 73 through preload spring 81 and retractor carrier 82. Due to the slots 87 in spring 81, the bearing 72 is biased with respect to pin 73 and bearing 70. The distance between facing tracks 75 and 77 is slightly less than the combined radii of bearings 70 and 72 (FIG. 5). In this way, when installed, the bearings are slightly pre-loaded. This insures contact at all times and insures tolerance take-up. Additionally, the spring 81 permits movement between bearings 70 and 72 without binding the bearings 70 and 72 with respect to tracks 75 and 77.

The roller bearings 70 are forced against and roll on tracks 77 of power cams 46 and 48 to cause them to rotate around axis A when the combustion in the power cylinder pushes the intake piston 38 and exhaust piston 40 apart (FIGS. 1 and 2). The roller bearings 72 act as idlers to maintain bearing contact with tracks 75 and 77, and the roller bearings 72 also assist in rotating the power cams around axis A when the momentum vector of each piston assembly is larger (and towards the top of the piston) than the force of acceleration being imparted to the piston assembly by the power cam. Obviously, the opposite may occur under other special circumstances. Roller bearings 70 drive the cams 46 and 48 during the power stroke of pistons 38 and 40. The small roller bearings or retraction bearings 72 roll on the tracks 75 of the power cams 46 and 48 respectively to actuate the intake piston 38 and exhaust piston 40 to assist in pulling the intake piston 38 and exhaust piston 40 to the end of the bottom dead center of the stroke. The intake piston 38 and exhaust piston 40 are then pushed together by the large bearings or roller bearings 70 rolling on the tracks 77 (i.e. when the acceleration force vector towards the piston top is larger than the momentum vector which is opposite in direction). Under certain conditions the large roller bearings 70 may have sufficient energy to position the intake piston 38 and the exhaust piston 40 the full travel of the stroke. In other conditions the small roller bearings 72 may have to assist to position the intake and exhaust pistons to bottom dead center. The track 77 of the power cams 46 and 48 are suitably contoured to a slightly larger radius than the large bearings 70 so that the bearing outer race will hydroplane on the cam surface, minimize the contact footprint, minimize the differential velocity of individual segments within the contact footprint as the bearing follows the radially aligned tracks, provide a built in cushioning, and prevent metal to metal contact.

The bearing packs are operatively supported by a four bar linkage assembly 172(FIG. 2). The assembly 172 has four bars connected between the mounting bars 174 on plate 170 and a bearing 178 (FIG. 2), mounted to pin 176 (FIG. 4). As should be appreciated, the bearing 178 is coaxial with pin 73 (FIG. 4) and bearings 70 and 72 (FIG. 4). In this way, there is no bending moment in the pistons 38 and 40. The four bar linkage 172 allows the linear movement of pistons 38 and 40 to be translated into rotational movement of the cams 46 and 48 with none of the reactive forces caused by the pistons driving the cams being translated through the pistons 38 and 40 to the cylinder wall 98.

Figure 19:
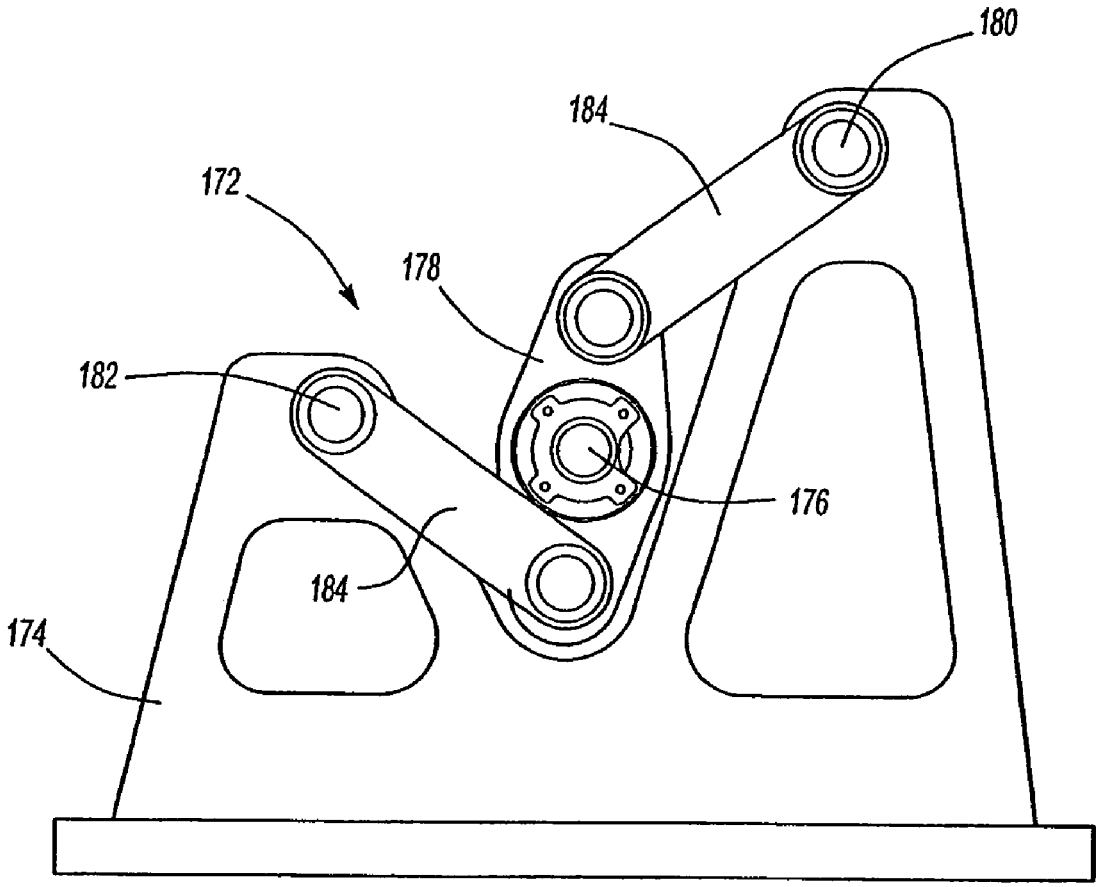
FIG. 19 is a side view of the mounting bars and fore bar linkage of the present invention.

The four bar linkage assembly 172 is further illustrated in FIGS. 19 and 20. The four bar linkage assembly 172 of the present invention guides the pistons 38 and 40 and reacts the side load of the cams 46 and 48 to the link mount points I at 180 and II at 182. Since the center coupler link or bearing 178 has a revolute center, none of the cams 46 and 48 side load is transmitted to the piston 38 and 40 and piston ring 130. There is a precise relationship between the geometry of the links 184 to give the desired straight line motion of the piston ring 130 and pistons 38 and 40. The relationship is the combination of the lengths of the four bar linkage assembly 172 components and the location of the mounting points 180 and 182.

By way of example, in one engine design, the pistons 38 and 40 have a stroke of 2.0 inches. To allow for tolerances and possible travel outside of the design range, an additional 0.1 inches was added to each end of the stroke. The lengths of the components were selected for a stroke of 2.2 inches. The linkage for the engine would have the following dimensions:

| | |
|---|---|
| Coupler link 178 Stroke: | 2.20 inches |
| Mount Point 180: | X = 1.7726, Y = 0.880 |
| Mount Point 182: | X = −1.7726, Y = −0.880 |
| Link Length 184: | 1.990 inches |
| Coupler Link 178 Length | 1.770 inches |

The ratio of these components must be maintained as the engine stroke is scaled up or down. Each component length is scaled linearly with the change in stroke. If the stroke is doubled, all the values must be doubled. To reduce the stresses on the components, all links are in double shear.

Figure 8A:
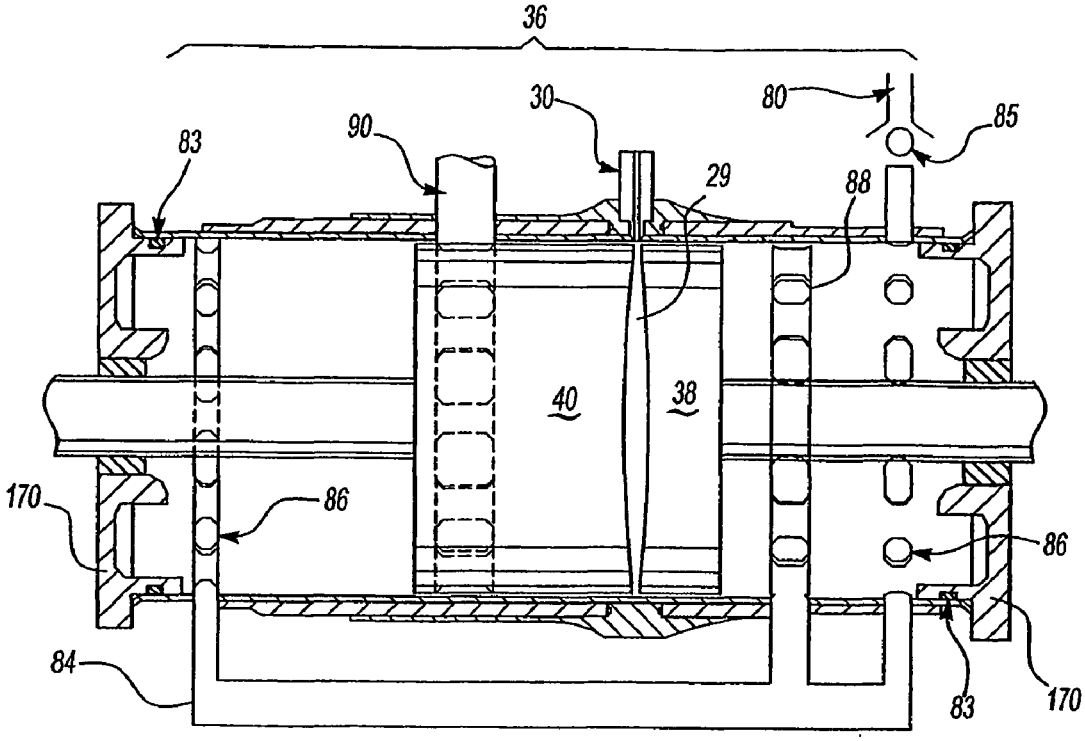
FIGS. 8A–8F are schematic views showing the operational cycle of the engine of the present invention.
Figure 8B:
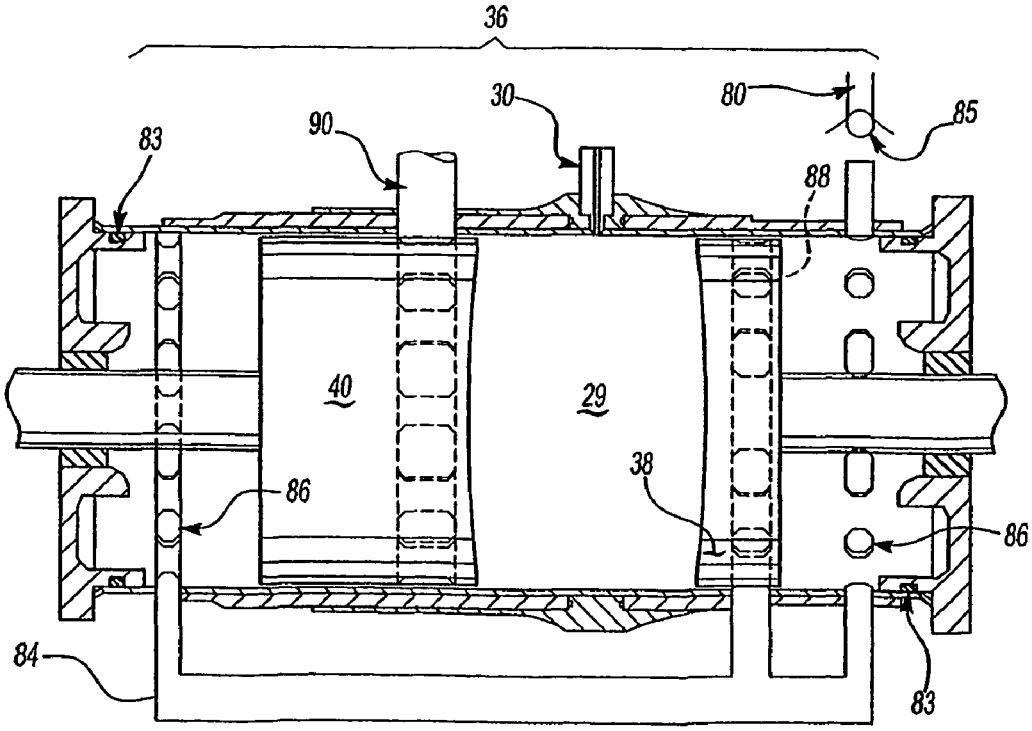
Figure 8C:
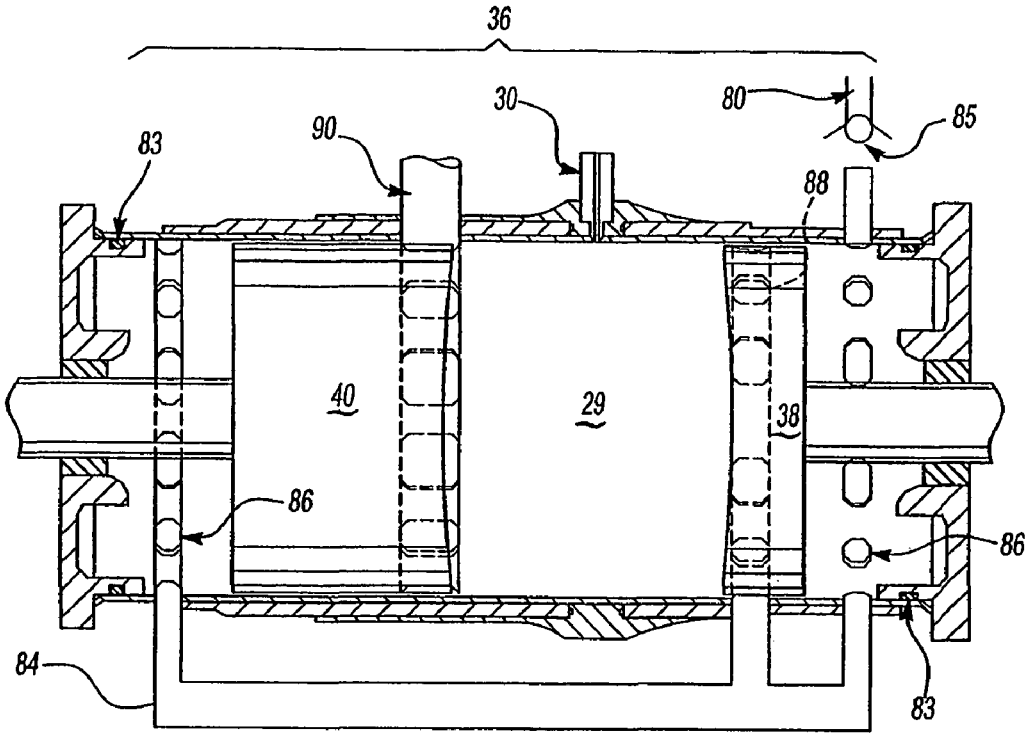

The engine's operating cycle is best illustrated by the schematic drawings of FIGS. 8A–8F where FIG. 8A illustrates top dead center. FIG. 8B illustrates the power stroke cycle, FIG. 8C is exhausting the power cylinder, 8D–8E is charging the base compression and purging the power cylinder and 8F illustrates the compression stroke cycle.

As shown in FIG. 8A the intake 38 and exhaust 40 pistons are located at the top dead center of their strokes and intake piston 38 and exhaust piston 40 are at the end of the compression stroke and in the power stroke and positioned as close to each other for correct compression ratio. As is apparent from the foregoing, the air in the working portion or compression chamber 29 of the power cylinder (the volume between intake and exhaust pistons) is fully compressed and fuel is timely introduced through the fuel nozzle injector 30 to cause an explosion forcing the pistons to separate. At this point of the cycle the inlet check valve 85 is open since the air on the upstream and downstream sides of the check valve 85 is basically at the same pressure or the pressure upstream is still slightly greater than the intermediate inlets 86 and 88 and the transfer tube intake or jumper 84. To maintain the sealability of the chamber represented by the contiguous volume under the pistons 38 and 40 (including inlets 88, 86, and intake jumpers 84), an o-ring seal 83 is used. This seal also accommodates the thermal differentials between the cylinder 36 and the plate 170. Also the pressures on the back sides of intake piston 38 and exhaust piston 40 are similar since they are in fluid communication with inlet port 80 via the intake jumpers 84 and the inlet passages 86 and 88. The exhaust port 90 is closed off by exhaust piston 40.

Figure 21:
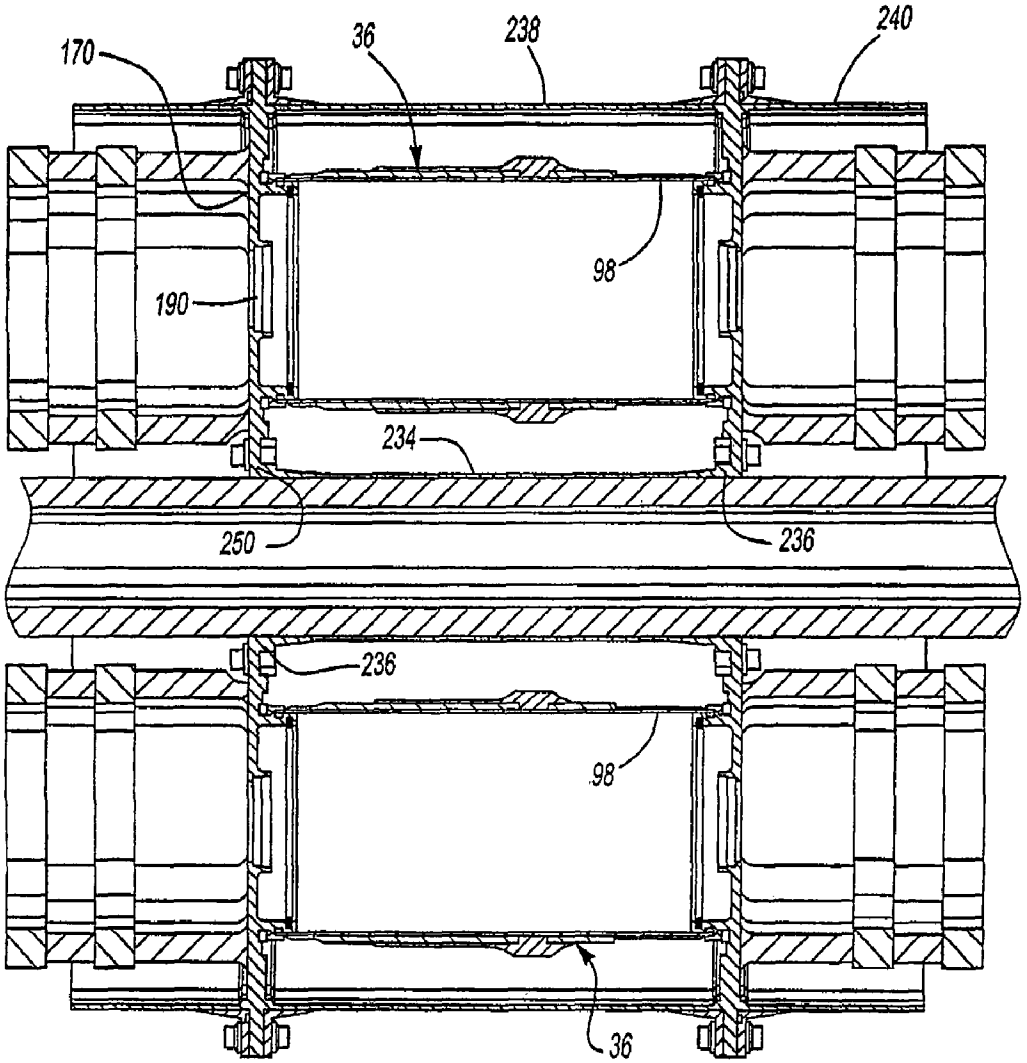
FIG. 21 is a cutaway view of the engine showing two power cylinders with the rotary shaft extending between the power cylinders.

With reference to FIG. 21 in the preferred embodiment, the power cylinder 36 is supported radially by a low spring rate o-ring seal 83 and is constrained in the engine by features on the endplate. These features maintain concentricity with the connecting rods 56 and 58 and rod seal hole 190 in the endplate 170. The axial location of the cylinder can be adjusted by a shim 251 to account for the tolerance of the machined components. The intake and exhaust endplates 170 are identical so the shim 251 is also used to fill the area on the intake side in the location where the spring 250 resides on the exhaust endplate 170.

The power cylinder 36 is loaded against the intake endplate 170 by the spring 250 that reacts on the other end to the exhaust endplate 170. The spring 250 (currently a wave spring) has sufficient spring force to overcome an inadvertant rub of the piston ring 130 or piston skirt on the power cylinder inner wall 98.

Referring next to FIG. 8B, as both pistons are translating back toward the dead end of the stroke, i.e. bottom dead center, the check valve 85 is closed so that gas cannot flow towards inlet port 80 and the pressures behind intake piston 38 and exhaust piston 40 increase. The pressure of the combusted products between pistons 38 and 40 in compression chamber 29 of the power cylinder assembly 36 decreases. The exhaust port 90 remains closed at this point of the cycle.

Referring next to FIG. 8C, the pistons are still moving apart and travelling toward bottom dead center and the exhaust ports 90 are opening and inlet passages 86 are blocked from communicating with the compression chamber 29 and are closed off by the check valve 85 so that air cannot flow towards the inlet 80. Consequently, pressure of the intake air continues to build under the piston. The exhaust gases are leaving the compression chamber. At this point of the cycle the pressure of fluid in the assembly compression chamber 29 of the power cylinder assembly 36 is quickly reducing towards its lowest value.

Figure 8D:
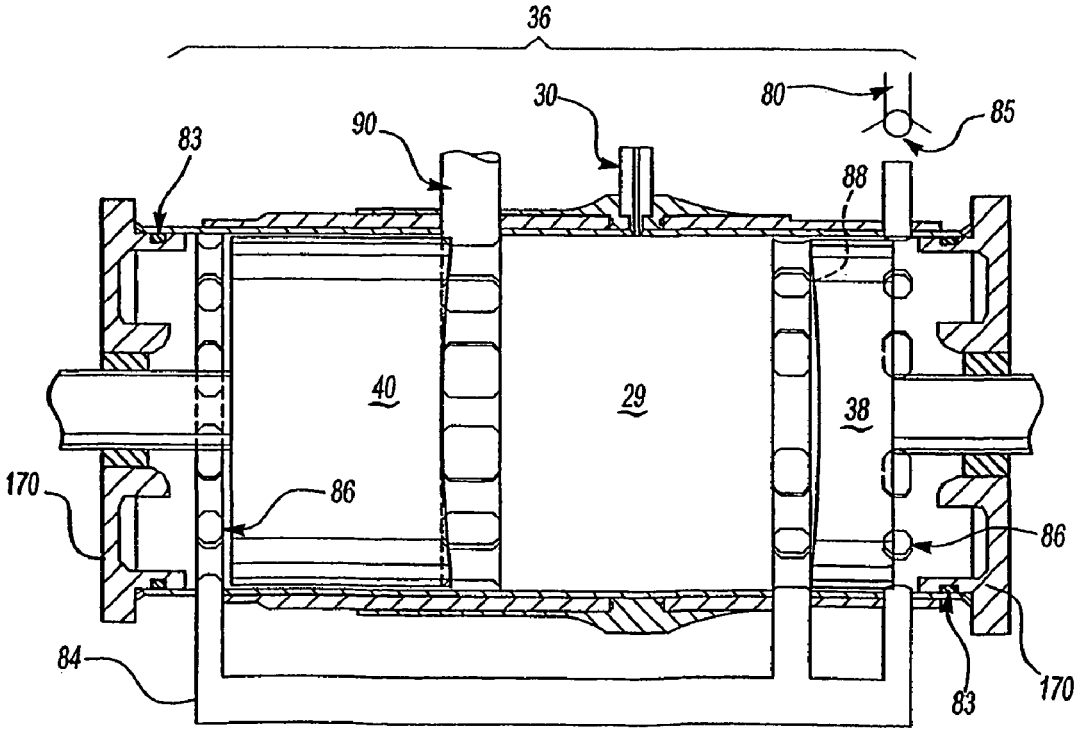

At the bottom dead center of the stroke as seen in FIG. 8D, the exhaust ports 90 are fully opened and the inlet passages 86 and 88 are in full communication with the compression chamber. This scavenges or purges the compression chamber 29 of power cylinder assembly 36 by allowing air trapped in the intake jumper 84 under a pressure higher than the compression chamber 29 to fill the power cylinder. It will be appreciated that prior to charging the power cylinder assembly 36, the air captured in jumper 84 is preheated by being in indirect heat exchange with the combustion products during the combustion process with a consequential increase in engine efficiency, because this allows the piston top to run at higher temperatures which allows high power density levels, and the thermal tapering of the cylinder is decreased. However, this percentage must be managed, too much is a detriment to overall engine efficiency.

It will be noted that in FIGS. 8B and 8C the air trapped behind the intake piston 38 and exhaust piston 40 is blocked from the compression chamber 29 by the intake piston 38 and that the intake jumpers 84 are only in communication with the volumes behind the intake and exhaust pistons 38 and 40. This air is completely trapped while the pistons are still in their power stroke. Hence, the power stoke further compresses this air. Since the pistons are close to the end of their stroke during the remaining portion of the power stroke as is viewed in the schematics depicted in FIGS. 8B and 8C and 8D the movement of the intake and exhaust pistons creates a very high pressure of remaining base compression air.

Figure 8E:
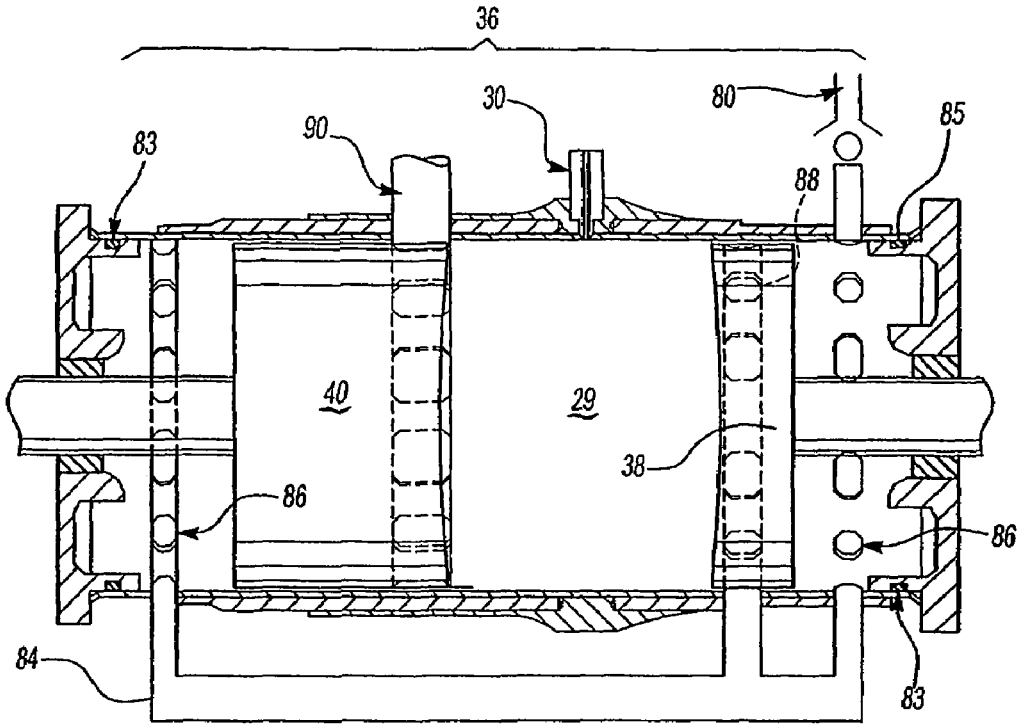
Figure 8F:
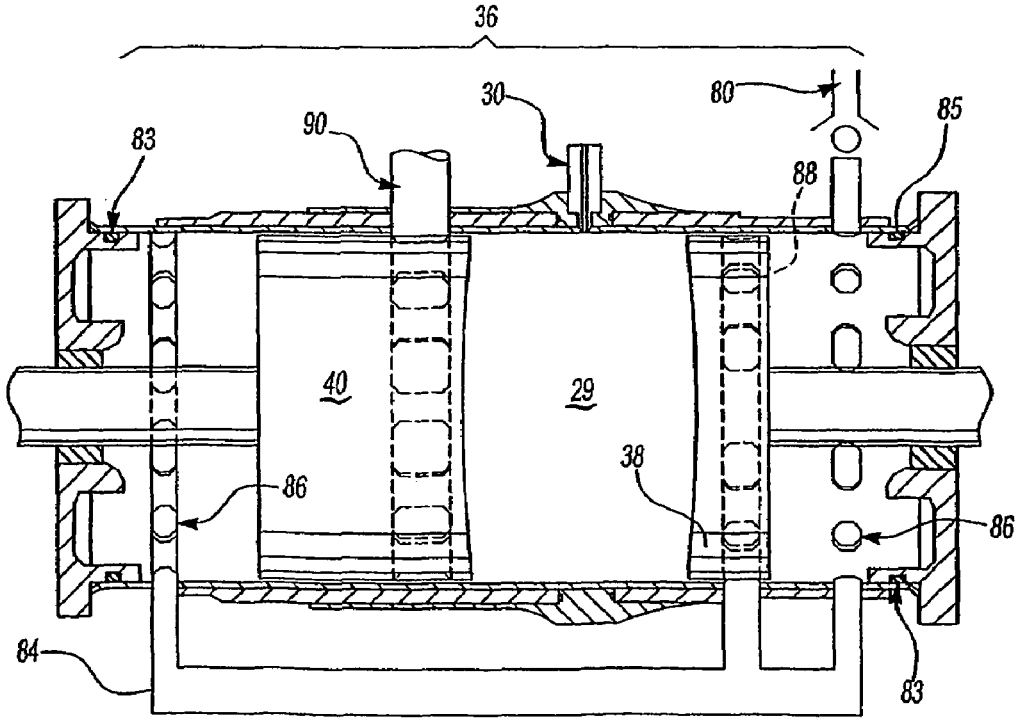

FIGS. 8E and 8F depict the compression cycle where the pistons are actuated by the power cams 46 and 48 toward top dead center which is the transition point of the power stroke (FIG. 8A). As the intake piston 38 and exhaust piston 40 move toward each other and pass over the inlets 86 and 88 and exhaust ports 90, the air trapped in the compression chamber 29 of the power cylinder compresses which causes the pressure to increase until it reaches the maximum value at the end of the stroke (top dead center) FIG. 8A. Once the pistons cross over the inlets 86 & 88, the back ends of the intake pistons 38 and exhausts piston 40 remain open to the inlet pressure and since the back pressure of the check valves 85 equals the ambient pressure and is greater than the pressure below the pistons 38 and 40, these check valves remain open and the back ends of the intake piston 38 and exhaust piston 40 draw in ambient air.

It should be appreciated by those of ordinary skill in the art that by changing the shape of the power cams 46 and 48, the engine's characteristics can be changed. For example, by adjusting the length of the flats in the power cams 46 and 48, the acceleration, velocity, emissions, power, etc., can be altered.

It will be appreciated from the foregoing that engine 10, does not require valving, such as the poppet type valves used for opening and closing the intake and exhaust ports inasmuch as these ports in this engine are opened and closed by virtue of the intake and exhaust pistons.

Figure 7:
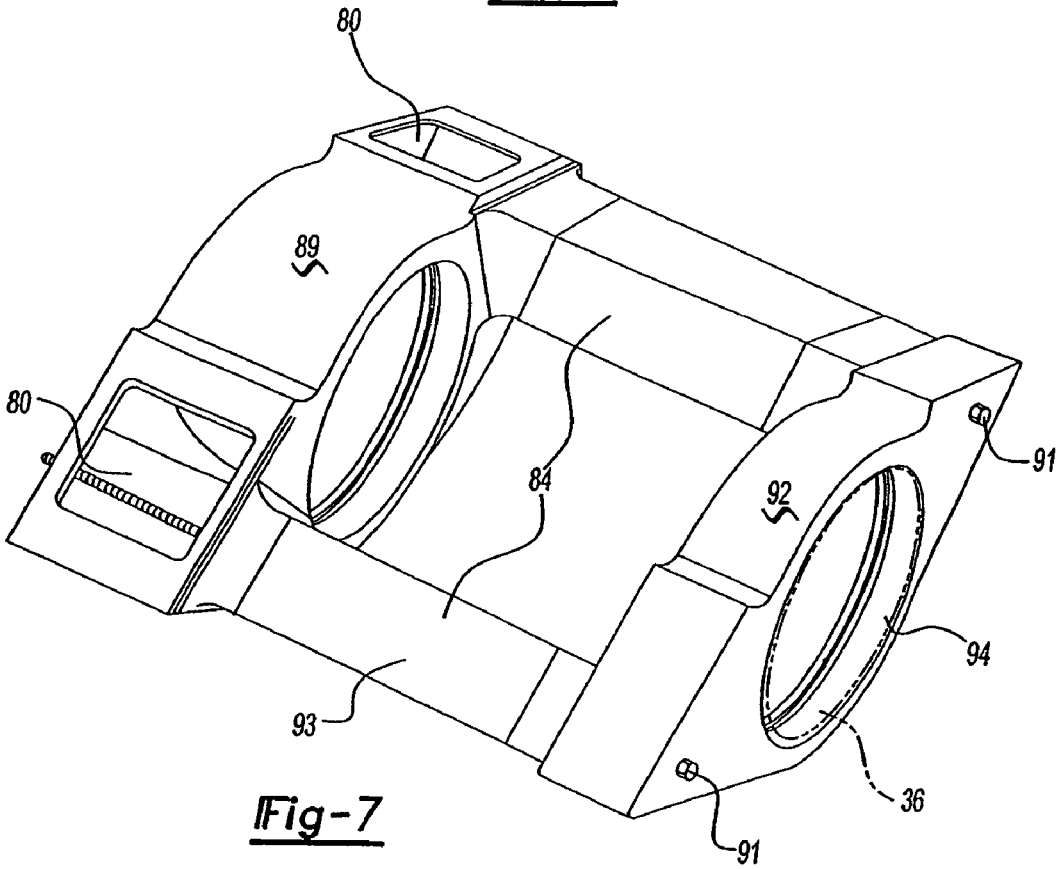
FIG. 7 is a perspective view of the base compression cylinder with the power cylinder shown in phantom.
Figure 7A:
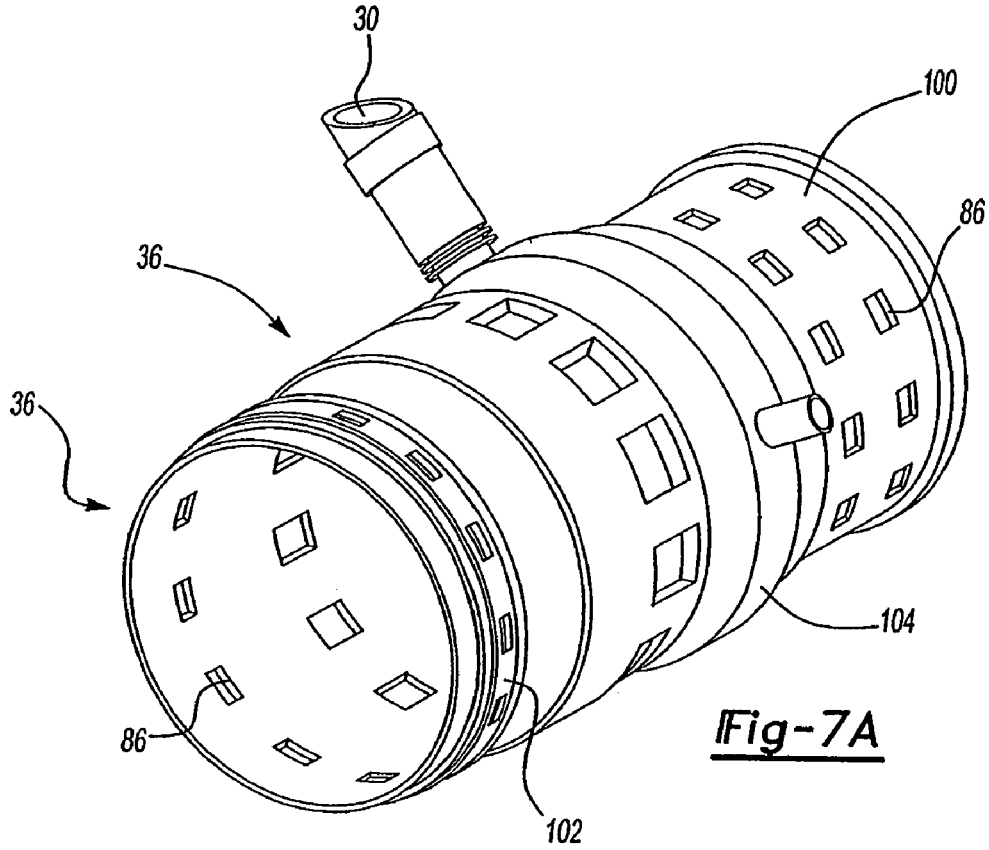
FIG. 7A is a perspective view of the power cylinder.
Figure 9:
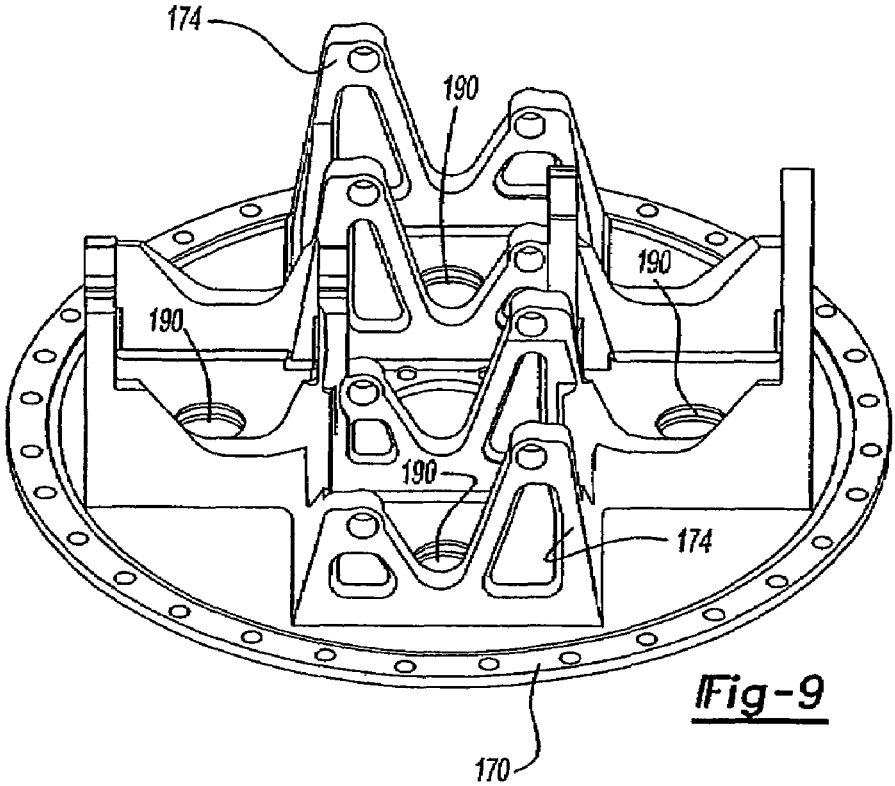
FIG. 9 is a perspective view of the inplate of the present invention.

With reference to FIG. 7, the base compression cylinder assembly is generally shown at 95 as partially surrounding cylinder 36 and includes a base compression cylinder manifold 92 which is mounted through tie bolts 93 and nuts 91 to an air intake manifold 89. The tie bolts 93 extend through the intake jumpers 84. The power cylinder assembly 36 is mounted within the manifold openings 94. The power cylinder assembly 36 is shown in FIG. 7*a* and will be discussed in greater detail below. In the disclosed embodiment, the intake check valves 85 (FIGS. 8A, 8B, 8C, 8D; 8E) are reed valves which mount in inlets 80 of the air intake manifold 89. The tie bolts 93 and nuts 91 connect the power cylinder assembly 36 and the base compression assembly 95 together into a single package. Each of these packages are then mounted between the plates 170 (FIG. 9). The plates 170 are then bolted to the outer case 12.

Figure 7B:
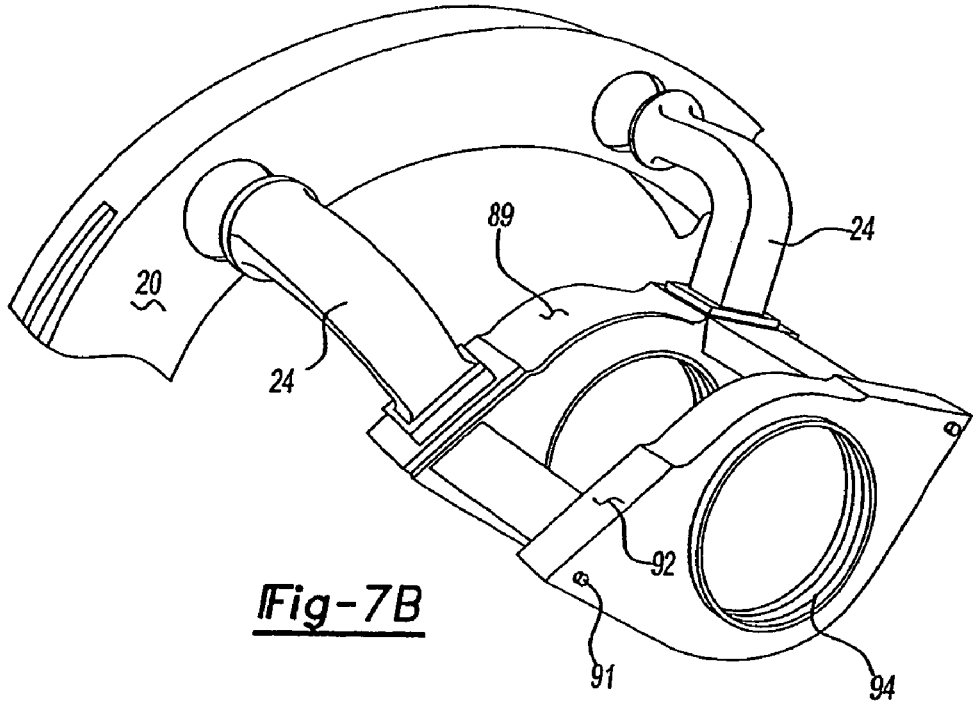
FIG. 7B is a perspective view of the base compression cylinder mounted to the inlet manifold through inlet conduits.
Figure 7C:
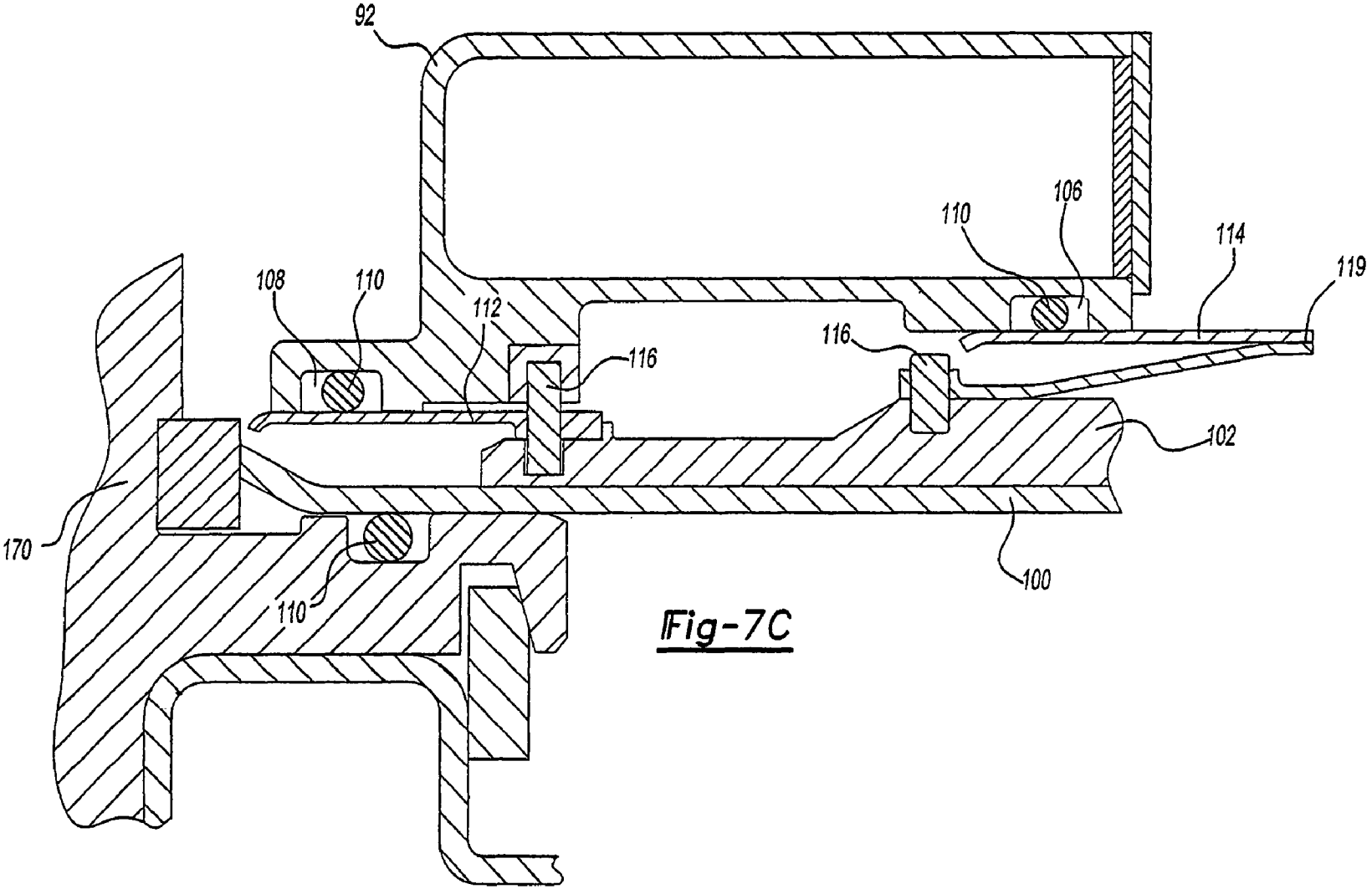
FIG. 7C is a cutaway view illustrating the connection of a power cylinder and base compression manifold to the end plate.
Figure 7D:
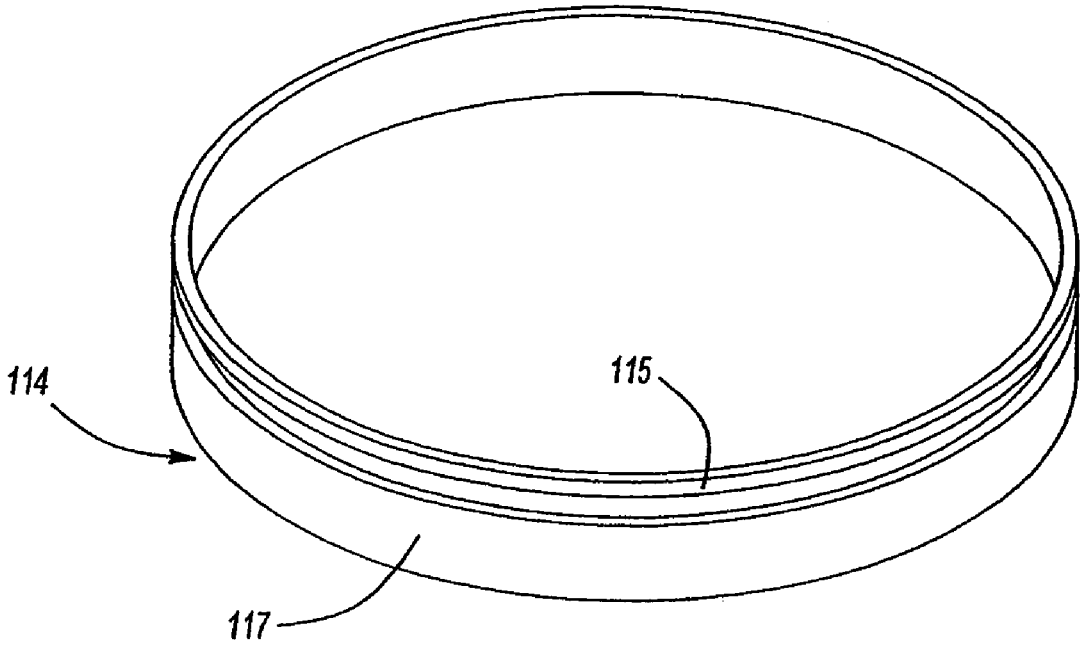
FIG. 7D is perspective view of a low radio load of the circumferential spring of the present invention.
Figure 7E:
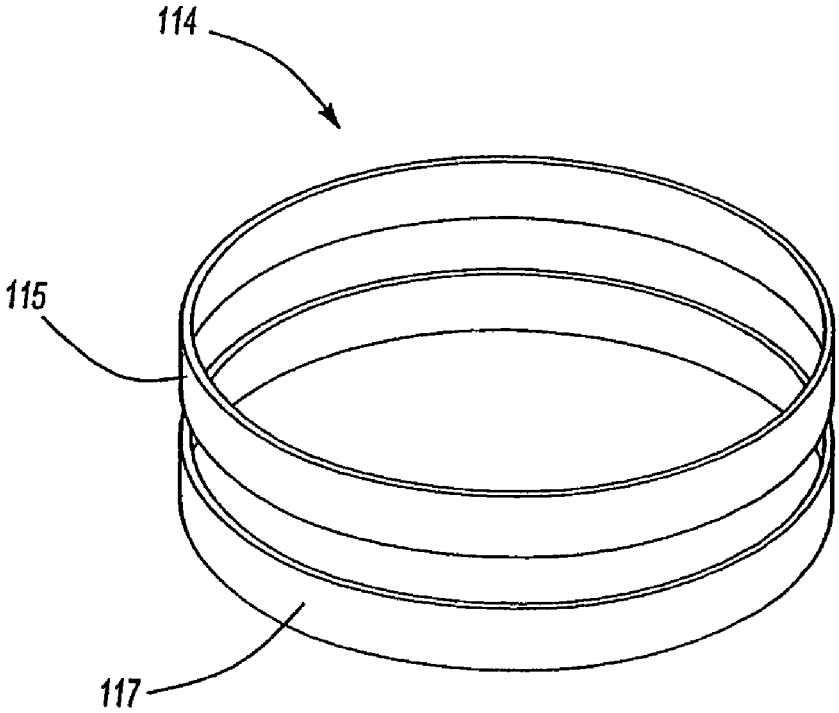
FIG. 7E is a perspective view of the ring of FIG. 7D.

With reference to FIG. 7*c*, the preferred method for mounting the power cylinder assembly 36 within the manifolds 89 and 92 will be discussed. The openings 94 of the manifolds 89 and 92 have slots 106 and 108 for receipt of O-rings 110. Positioned between the manifolds 89 and 92 and the power cylinder assembly 36 are low radial load circumferential springs 112 and 114. As illustrated, spring 112 is preferably a straight spring and spring 114 is preferably a V-shaped spring. The V-shaped spring 114 is shown in more detail in FIG. 7*d*. Spring 114 is preferably made from an annular inner sleeve 115 brazed to an annular outer sleeve 117 at one end 119 thereof. Both springs 112 and 114 are preferably made of low thermal conductivity material. In FIG. 7C, the springs 112 and 114 are pinned by pins 116 to the cylinder assembly 36 and more particularly to second tube 102. The pins 116 are preferably press fit into openings in the power cylinder assembly 36 and more particularly second tube 102. With respect to spring 112 an opening is also provided in the manifold for receipt of pin 116. The use of springs 112 and 114 in conjunction with O-rings 110 provides a proper seal, but also allows for balancing of the spring rates between the coupled elements. A further O-ring 110 is mounted between plate 170 and power cylinder assembly 36 to complete the seal. A shim is shown in this figure.

With reference to FIG. 7*b*, the interconnection of the inlet manifold 20 or air collector through the inlet conduits 24 to the air intake manifold 89 is illustrated.

Figure 10:
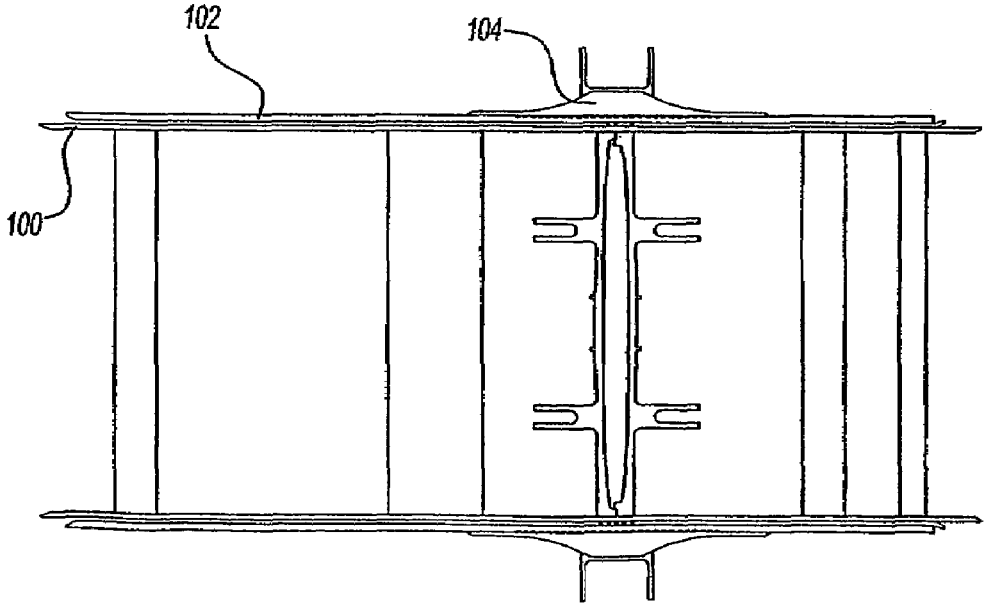
FIG. 10 is a cutaway view of the power cylinder showing the pistons at top dead center.

With reference to FIGS. 7A and 10, power cylinder assembly 36 will be discussed. The power cylinder assembly 36 is constructed of three different materials to both block and facilitate heat transfer and in particular to maintain the cylinder at a fairly consistent and average temperature along its entire length. It is critical that the power cylinder temperature be maintained as close to uniform as possible to prevent distortion of the power cylinder assembly 36. If, as is typical of standard internal combustion engines, the cylinder temperatures are not maintained, the diameter of the cylinder 36 could vary, creating difficulties with wear, piston gas bypass, loss of efficiency; and in the present engine, difficulties with the air bearings which will be described in greater detail below. Typical internal combustion engine cylinders expand in hotter regions creating a coning or tapering effect. By maintaining the cylinder temperature within a narrower range along its length, there is no appreciable coning or tapering effect.

As will be appreciated, the temperature of the cylinder 36 is going to be higher than that found in typical internal combustion engines. This does not create a problem for this engine for several reasons. The cylinder 36 doesn't contain oil as a lubricant, air is used, the thermal mass and thermal conductivity are lower, and the frictional heating created by piston side loads and oil shearing is not an issue with this engine. Therefore, higher temperatures are acceptable. The key is to apportion the heat generated by combustion along the length of the cylinder 36 in a generally uniform manner.

Heat apportionment is achieved by using three separate materials in cylinder 36. The first material is steel, preferably A286. In the disclosed embodiment a steel tube 100 is used. As illustrated in FIG. 7A, inlets 86 are formed in tube 100. This material has a high alpha (thermal expansion coefficient) and low conductivity. Mounted about tube 100 is a second tube 102 of material made from copper. It should be appreciated the tube 102 does not have to be a tube but could be strips of material etc. Tube 102 is in two parts and is mounted adjacent the combustion chamber forming a gap between the two parts at the combustion chamber. Copper has a high alpha and high conductivity. The third material is a stainless steel sleeve 104 mounted about the combustion chamber and partially covering tube 102. This sleeve 104 has a low alpha and very low conductivity.

With this construction, heat generated within the combustion chamber is predominantly blocked by the sleeve 104. A majority of any heat absorbed into sleeve 104 is directed down the copper tube 102. The copper tube 102 being highly conductive, quickly normalizes the temperatures between any heat transferred from the low conductivity sleeve 104 and the cold end of the cylinder 100 which is farthest away from the combustion zone. Thus, this construction minimizes tapering caused by thermal stresses. The stainless steel sleeve 104 reduces if not eliminates tapering at the combustion chamber because of its very high alpha and resists heat because of its low conductivity. In this way, tapering is reduced or eliminated and balanced between the different thermal regions along the cylinder 36 and at the combustion chamber heat is maintained within the combustion chamber during the initial stages of the power stroke where it can provide useful work. It should also be noted that the comparative alphas are critical so that the sleeve to sleeve mechanical contact is maintained at various temperatures and thermal gradients. In this preferred embodiment, the mechanical contact is primarily the result of thermal assembly with a minor role played by brazing. Obvious, to one skilled in the art this same result could be obtained using other mechanically constrained interfaces or braze/solders.

Figure 11:
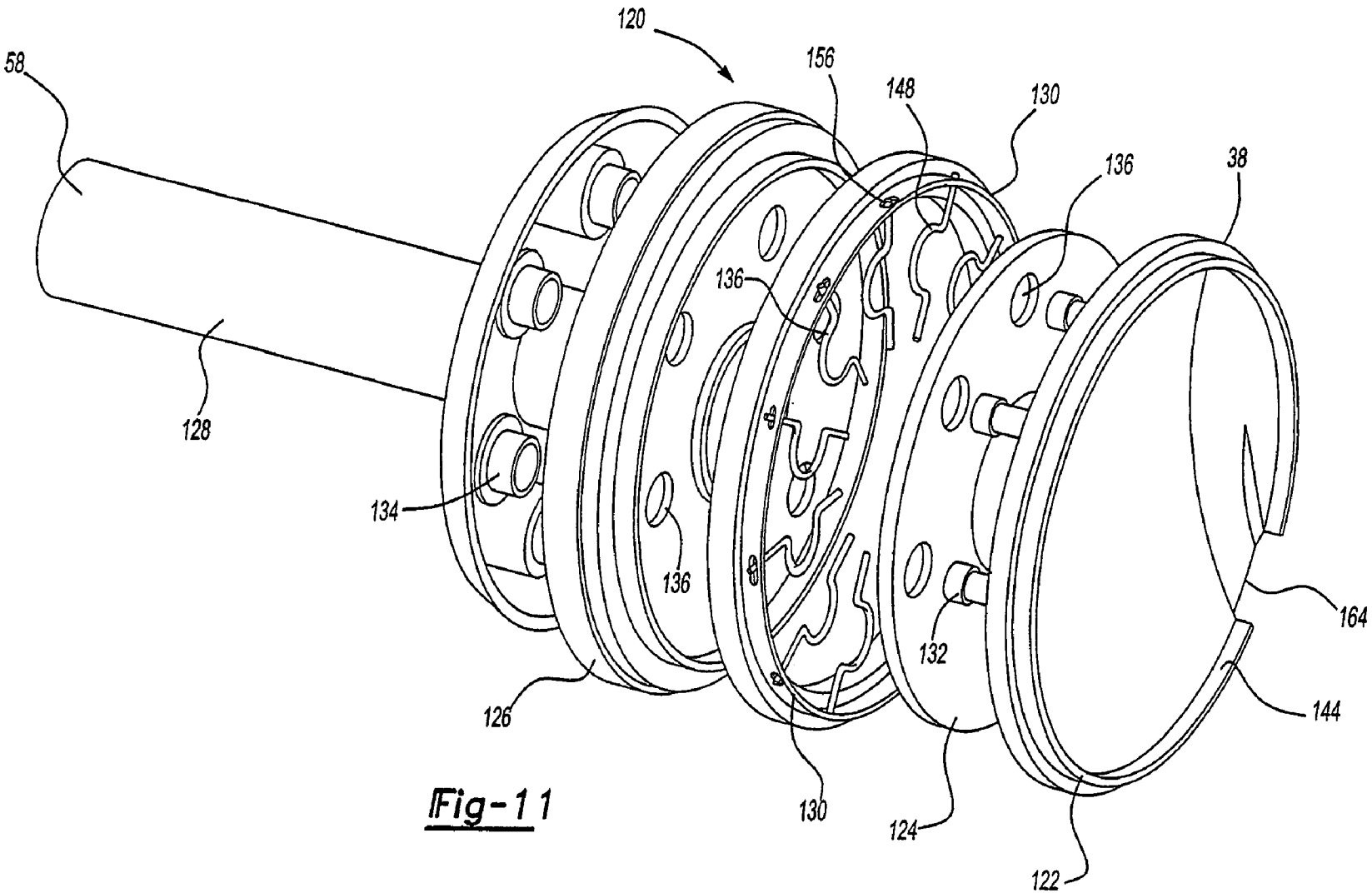
FIG. 11 is an exploded view of the piston of the present invention.
Figure 13:
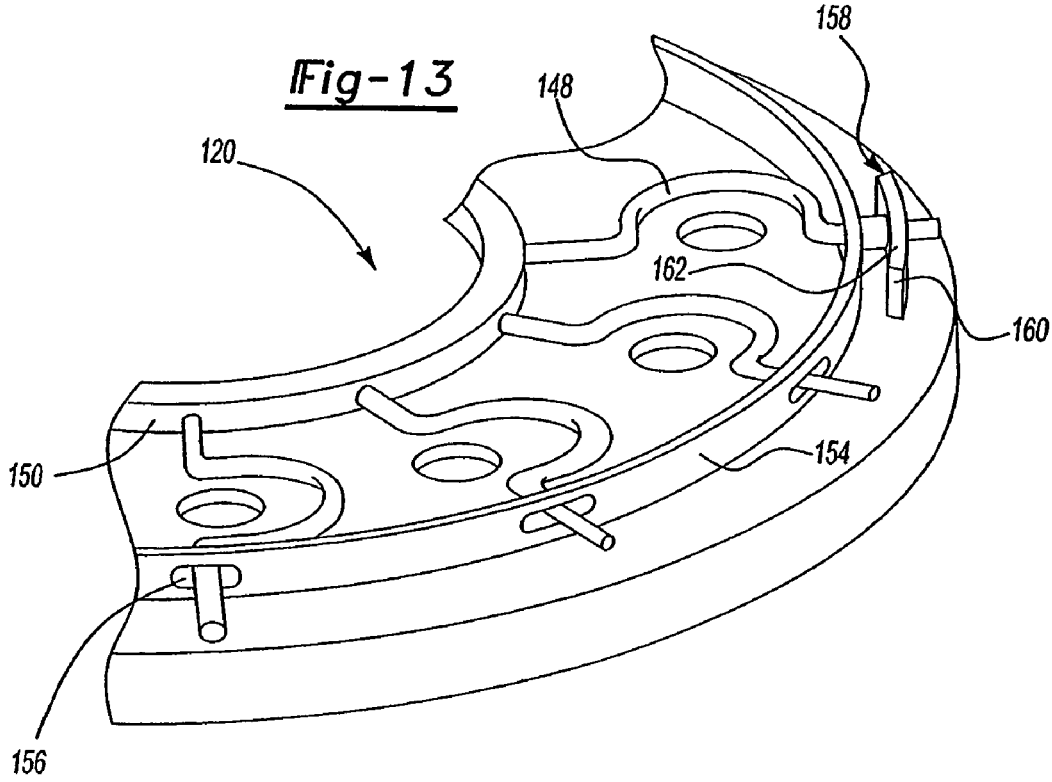
FIG. 13 is a partial perspective view of the piston ring of the present invention.

With reference to FIGS. 11 and 13, the piston assemblies 120 will be described. In the preferred embodiment, the piston assemblies 120 include a piston top 122, a ring pack top 124, ring pack bottom 126, a piston base 128, and a piston ring 130. The various components which make up the piston assemblies 120 are bolted together by bolts (not shown) that are inserted into protrusions 132 extending from piston top 122 through protrusions 134 extending from piston base 128. The protrusions 132 extend through openings 136 on ring pack top 124 and bottom 126. The protrusions 132 and 134 and the bolts once again allow the spring rates to be managed.

Figure 12:
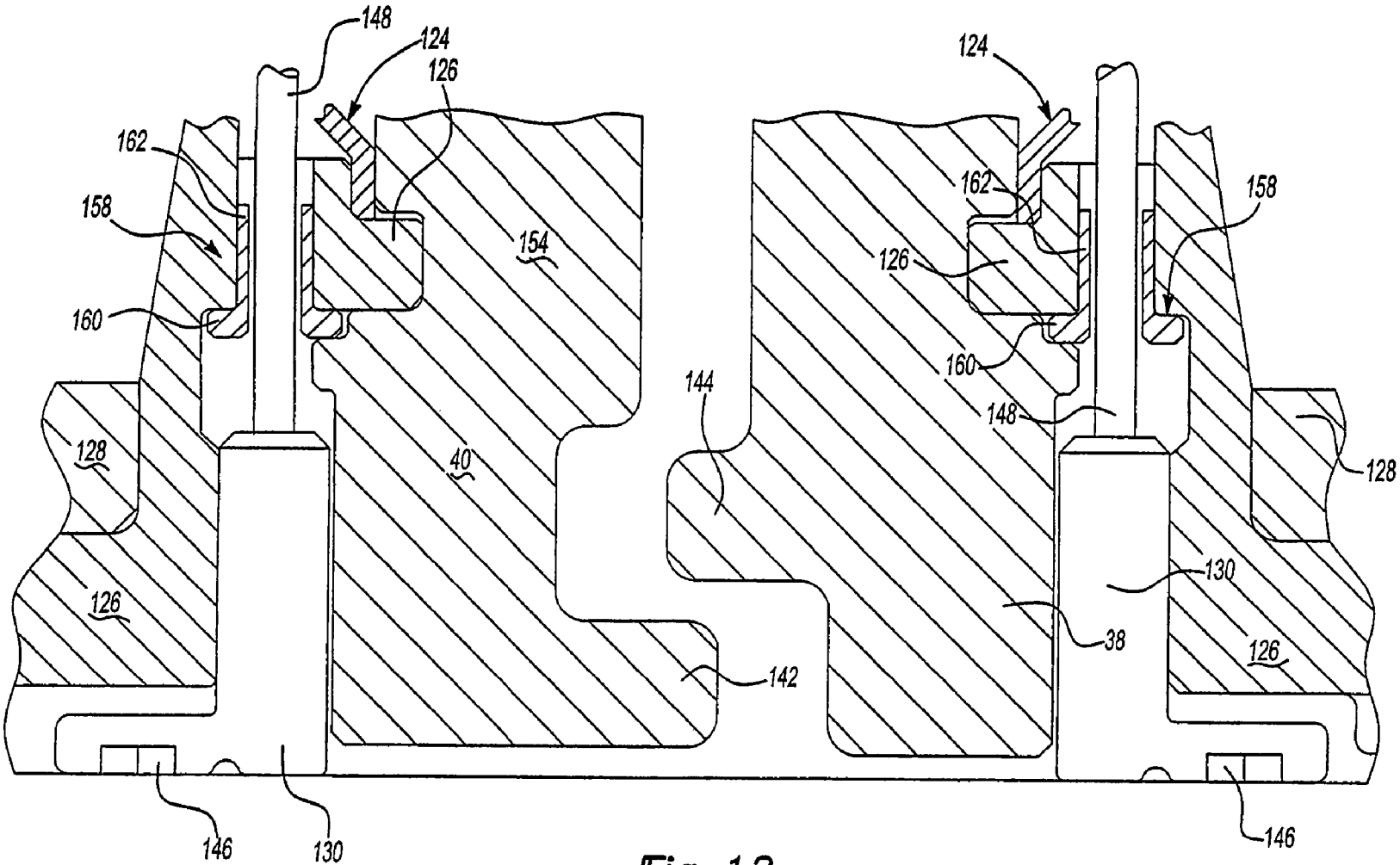
FIG. 12 is a partial cutaway view of the piston showing the hydrostatic bearing of the present invention.

The piston tops 122 are specially constructed to reduce the radiant heat effect against the cylinder walls 98. As illustrated in FIG. 12, the face 42 of the exhaust piston 40 and the face 44 of the intake piston 36 have overlapping surfaces 142 and 144 about the outer perimeter of the faces.

These overlapping surfaces 142 and 144 shield the cylinder wall from radiant heat generated during combustion and traps the radiant heat in the combustion chamber. It should be appreciated that the overlapping surfaces could have a different shape. For example, the protruding portion 142 could be on intake piston 38 and portion 144 could be on piston 40.

To further manage combustion in engine 10, a fuel injection cavity 164 is provided in the piston top. The cavity 164 is longer than it is wide to direct fuel along the path for complete combustion and to insure that no liquid fuel contacts a solid surface prior to combustion.

Continuing with reference to FIGS. 11 and 12, the piston ring 130 of the present invention is preferably a split piston ring with hydrostatic lift pockets 244. Pressurized air flows to the circumferentially spaced pockets 244 formed in each of the split rings via small diameter flex tubes 148. The flex tubes 148 are generally U-shaped to allow for a defined spring rate curve. Flex tubes 148 are plugged into a central air manifold 150 which receives pressurized air which is piped from the piston base 128. The pressurized air flows from the connecting rods 56 and 58 and into the openings in manifold 150. See FIG. 13. A retaining wall 154 receives the free ends of flex tubes 148 which are in turn fed through the seal 158, and then plugged into ring 130. See FIGS. 11, 12 and 13. The retaining wall 154 has a plurality of slots 156 for receipt of tubes 148 and seals 158. The slots 156 allow for lateral movement of tubes 148. The seals 158 have a face plate 160 and relatively long body 162. The body 162 receives the tube 148 and fits in slot 156 and face plate 160 engages wall 154. The long body 162 acts as an effective seal within slot 156 and against the tube 148. The face plate seals the opening in slot 156. This combination of sealing methods seals combustion gasses out of the cavity in pistons 38 and 40.

The air supplied by the tubes 148 flows into the lift pockets 244 in the ring 130 to lift the pistons 38 and 40 off the cylinder wall. The pockets 244 are equally spaced or arranged for optimum positioning around the circumference of the piston rings so that the air admitted compresses the piston ring relative to the cylinder and additionally locates the piston. Each of the tubes 148 are bent in a generally U-shaped configuration and since one end is affixed to the piston and the other end is affixed to the piston ring, the pressure in the tubes and the stress in the tube walls will create a force that together with the hydrostatic lifting forces will space and float the piston and piston rings relative to the walls of the power cylinders. Tubes 148 are made from a suitable flexible and resilient material (either metal or a composite material) that exhibit good compliant characteristics so as to have a sufficient spring rate to properly load the piston rings as was described immediately above.

As is apparent from the foregoing the air for the hydrostatic bearings lubricates and cools the piston rings and provides additional combustion air albeit a small amount. In addition the hydrostatic bearings float the piston and piston rings which serve to minimize the side loadings and friction. The side loadings are further eliminated by use of the four bar linkage system. The centering action of the hydrostatic bearings also serves to minimize blowby between the ring and the cylinder.

The air bearing piston ring 130 is a low mass airflow device but, more importantly, only requires 100 to 200 psig to operate. These lower actuation pressures result in several benefits. One is a very low parasitic power loss (e.g. the power required to supply this air would run from 0.6 to 3.2 hp, respectively for a 50 hp cylinder). Secondly, pressurizing ambient air to 100 or 200 psig results in less heat added to the air. Therefore its temperature is not increased substantially. Consequently, the value of the pressurized air as a coolant for the piston ring 130 is enhanced. This, in turn, allows higher power levels to be run before the material limits of the ring 130 are reached.

Lower actuation pressure is achieved by depressed trenches 242 that surround the support pockets 244. These trenches 242 communicate with the low pressure side of the pistons 38 and 40 (e.g. opposite the combustion side). Trenches 242 consist of circumferential grooves 246 and by-pass slots 248. Slots 248 are typically at a lower pressure, therefore the air bearing effect works. To maximize the amount of lift for the provided actuation pressure, the flowable area of the pockets 244 is maximized for the circumference.

During the dynamic combustion process where very high pressures are incurred above the air bearing piston ring 130, a very complex set of events are evolving that are more effectively managed by this newly configured & optimized ABPR. For example, this ABPR operating in a 50 hp cylinder could provide a ring to cylinder clearance of 0.00090" with 0 psig above the ring 130 and a low 0.00010" or even 0.00000" at combustion at top dead center with supply pressures of 10 psig to 200 psig, if the designer should desire. However, at 0.00000" of clearance, special care must be taken to plan for the minimal wear that would eventually occur in this zone very near top dead center. This happens because at combustion, the hydrostatic life force must be significantly large to lift the ring off the cylinder.

Figure 22:
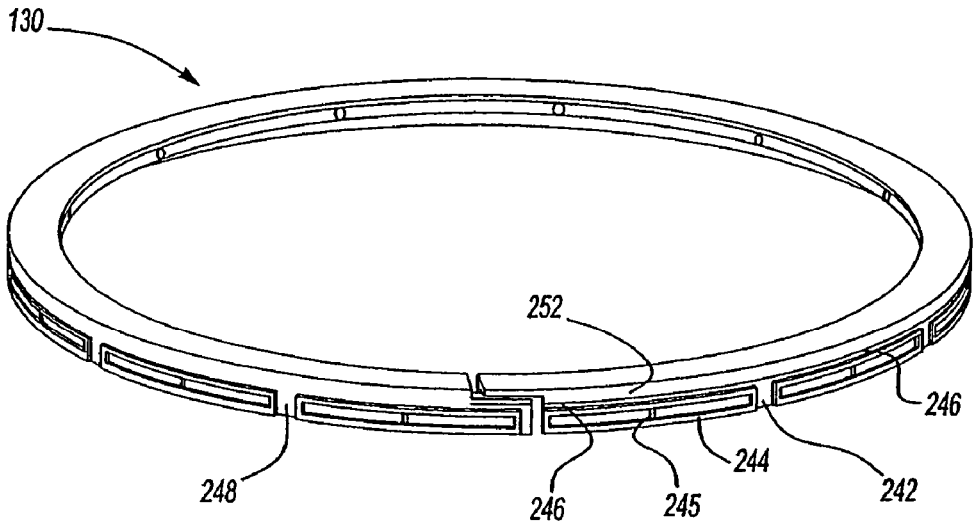
FIG. 22 is a perspective view of the air bearing piston ring of the present invention.
Figure 23:
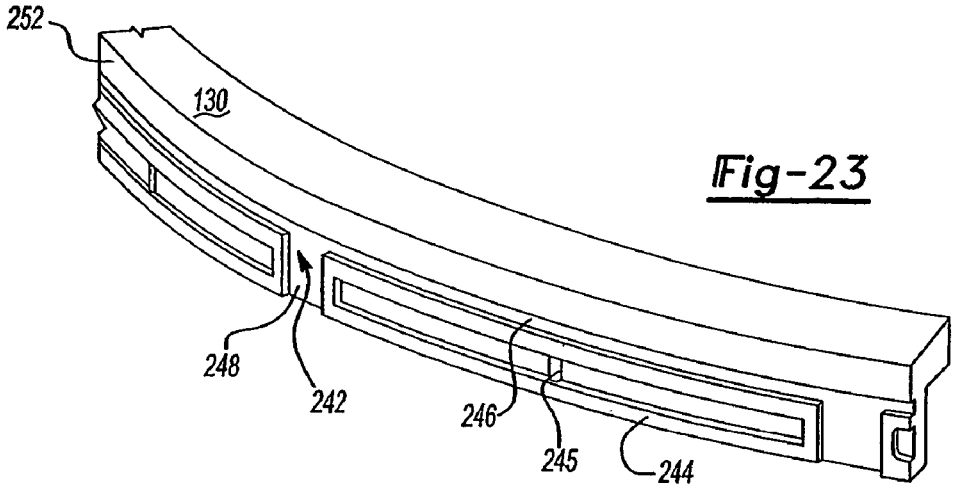
FIG. 23 is a cutaway view of the air bearing piston ring of the present invention.
Figure 24:
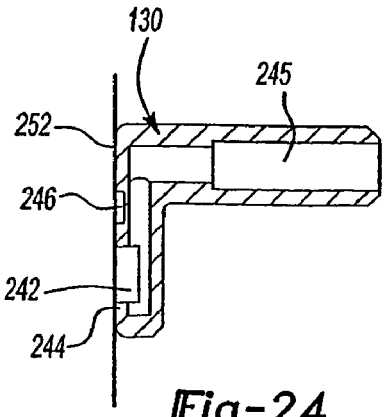
FIG. 24 is a sectional view through the air inlet of the air bearing piston ring.
Figure 25:
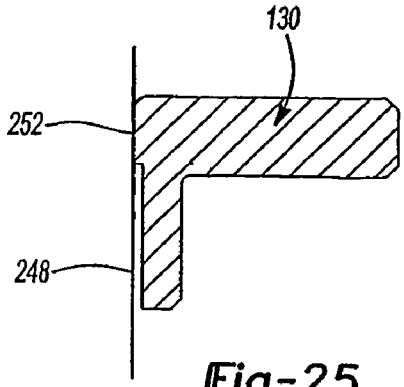
FIG. 25 is a section through the bypass slot of the air bearing piston ring of the present invention.

This levitation force during combustion must be large because in opposition are the loads of the air supply tubes or lines 204 and the net combustion pressure on the backside of the ring 130. The combustion pressure on the frontside of the ring 130 is not as critical since its effective area of its impact is smaller than the combustion pressure area on the backside. This frontside area is represented as surface A in FIG. 22. This net force pushes the ABPR radially outward and reduces the ring-to-cylinder clearance. Also, any high pressure combustion leakage (blowby) is quickly short circuited by the trenches 242 and prevents backfeeding into the inclusions. This short circuiting maintains the cooling effect of the supply air at the ABPR, prevents combustion product contamination of the pads/inclusions, and insures high frequency response of the ABPR levitation system to changes in its force equilibrium.

This wear would be minimal for several reasons: no piston side loads, seat-out (0" clearance) occurs at very low piston velocities and wear is a function of frictional force and velocity differentials.

The air bearing piston ring 130 is lubricated with air rather oil. The purpose of the piston ring 130 is to minimize the leakage of the combustion pressure and this requires a very small radial clearance between the ring 130 and cylinder wall 98. The clearance between the piston ring 130 and the wall 98 is small and is just large enough to levitate the load, i.e., the piston 38 and 40. The unique feature of the piston ring 130 is that is self equalizing. For example, if too much air is leaking out around the edges of the lift pocket or support pockets 244, the clearance decreases to reduce the airflow rate to equal the air supply rate. Conversely, if the air leakage out of the edges of the lift pockets 244 is too small, the air pressure increases and lifts the load to attain the correct airflow. It has been found that the functional clearance with airbearing piston rings 130 is small and in the correct range to provide acceptable combustion pressure ceiling. This clearance is similar to a typical radial clearance when oil is separating a piston ring from a cylinder wall and, more importantly, the clearances are centered around the piston. In a normal oiled piston, the piston side loads create an eccentricity that increases blowby. Thus the small, centered air filled clearance is functionally equivalent the eccentrically distributed, oil filled clearance of an oil lubed piston and ring assembly.

An optimum combination of functional variables exist to provide the best sealing and minimum rubbing contact for virtually no wear. The prime variables that control the function of the piston ring 130 are:

1. Pressure differential between secondary air supply pressure versus piston ring pocket sink pressure=$\Delta P_S$
2. Air flow rate #/second=$Q_S$
3. Air pocket area and quantity of pockets $A_N$
4. Perimeter length around air pockets ($P_L$)
5. Spring rate of piston ring ($k_R$)
6. Spring rate and preload of air supply tubes set by offset bend dimension ($k_t$)
7. Coefficient of friction between piston groove ($f_G$) land and piston ring seal surfaces.
8. Air supply tube inside air flow area ($A_t$)
9. Low pressure sink groove size and depth around the piston ring pocket ($A_S$)
10. Piston ring to cylinder radial clearance ring ($R_C$)
11. Combustion Pressure maximum value and range $$P_C \frac{Q_S = \Delta P h^2 hb}{12\mu l}$$

12. $Q_S$=pending air flow Clearance=f($\Delta P_S$, $Q_S$, $A_N$, $k_R$, $k_t$, $f_g$, $A_T$, $A_S$, $P_C$,μ, $A_{CI}$, $A_{CD}$)
13. Area of ring inside diameter exposed to combustion pressure $A_{CI}$
14. Area of ring outside diameter exposed to combustion pressure $A_{CO}$ All of the above listed variables are adjustable to meet differing requirements. For each requirement there is an optimum combination to minimize either wear or leakage. For example, if abrasive fuel is a requirement, these variables can be adjusted to float the ring on an air film through the entire stroke, with a small increase in blow by. For maximum efficiency and minimum blow by, the ring seals land would contact the cylinder when exposed to high pressures from initial combustion at top dead center. To minimize the wear at the region of contact the cylinder can have a suitable coating over a very short travel at top dead center and then float the ring the rest of the stroke, with a small wear penalty. Both the intensity of the ring to cylinder contact pressure and, or length of stroke with contact are adjustable. For example, increasing the second air pressure $\Delta P_S$ alone will reduce the stroke length of high piston ring contact pressure and slightly reduce the contact pressure.

Figure 14:
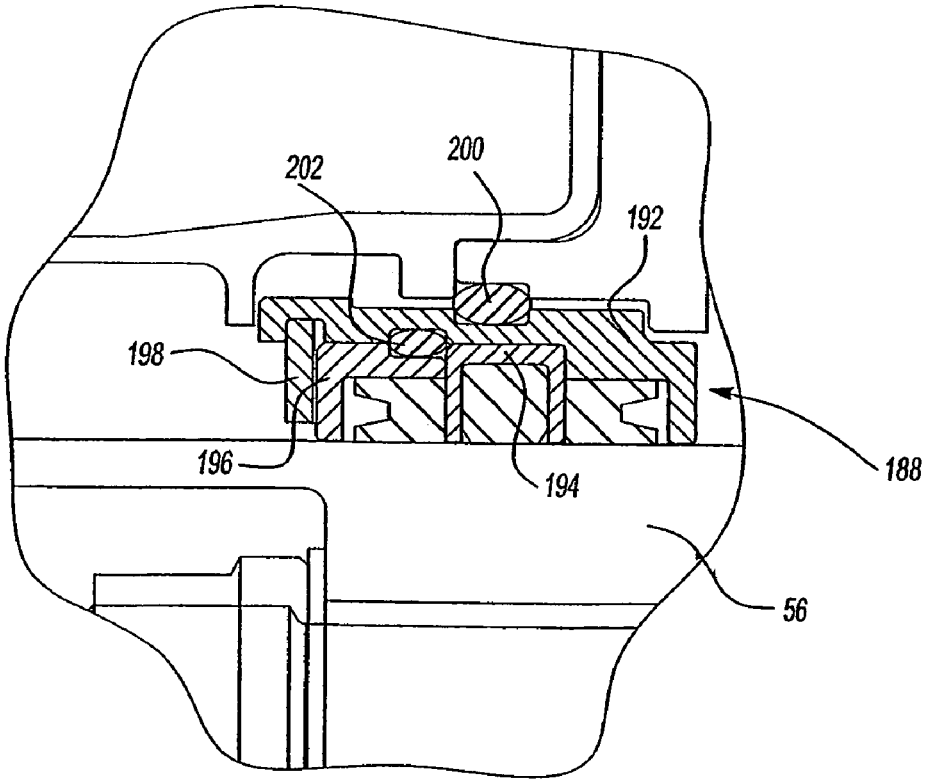
FIG. 14 is a cutaway view of the piston rod seal pack.
Figure 15:
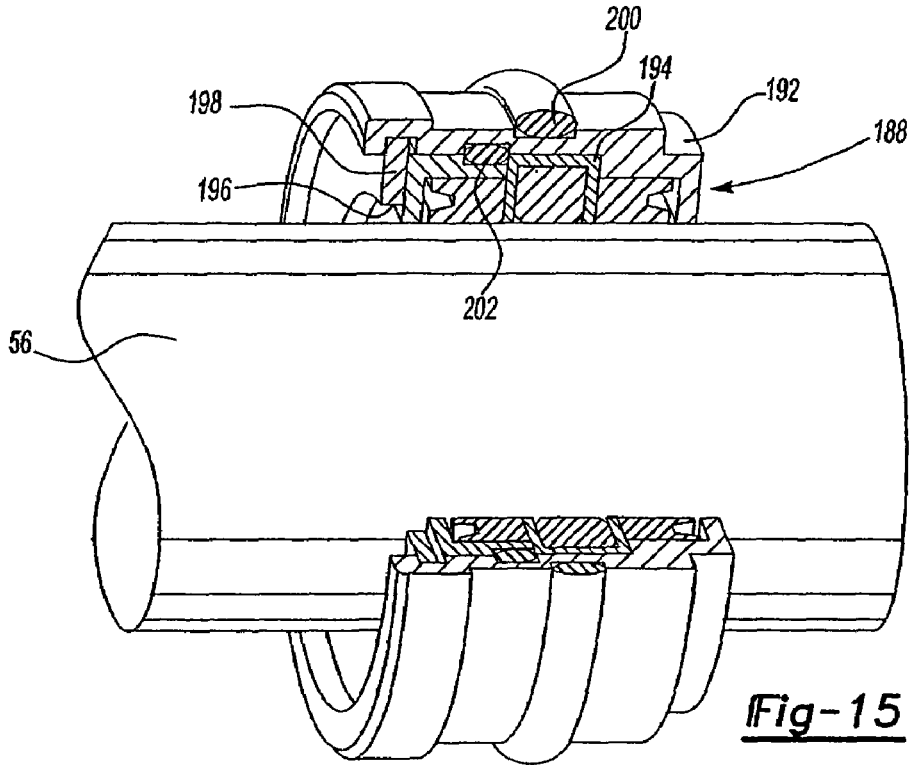
FIG. 15 is a partial perspective view of the piston rod seal pack.
Figure 16:
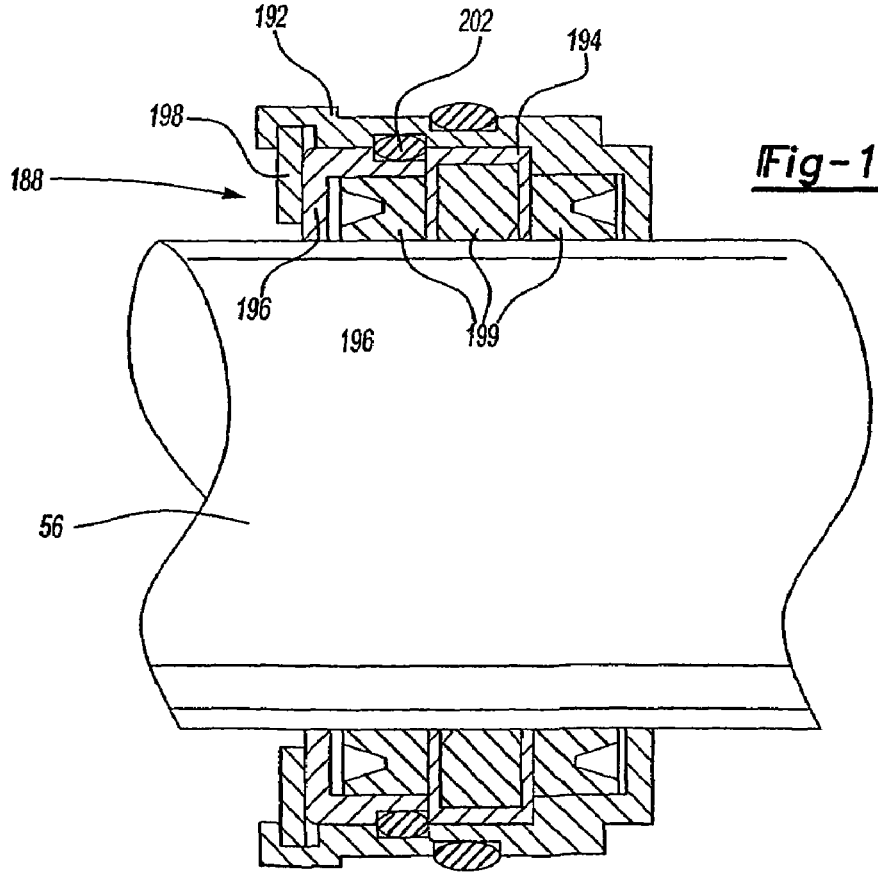
FIG. 16 is a cutaway view of the piston rod seal pack of the present invention.

With reference to FIGS. 14, 15 and 16, the piston rod seal pack 188 will be described. The piston rod seal pack 188 seals the piston rods or connecting rods 56 and 58 with respect to the openings 190 in plate 170. The connecting rods 56 and 58 reciprocate within seal packs 188 mounted in openings 190.

The seal packs 188 are constructed to seal the rods 56 and 58 with respect to openings 190 and to allow for slight lateral movement of the rods 56 and 58 and the seal pack 188 relative to the plate 170. The seal packs 188 have an outer casing 192 and two inner casings 194 and 196. The casings are held together with a snap ring 198. It should be appreciated that a single housing could be used, but for ease of manufacture, three separate casings were used. To use the high grade seals in a one piece installation would have contorted the seals beyond their elastic limits and decreased their sealing effectiveness and durability. (It should also be noted that it may be possible for a production environment and for some applications to use engineering materials that could be overmolded around the seals.) The casings contain seals 199 which seal against the connecting rod. An O-ring 202 is mounted between casings 194 and 196 and shares a groove in casings 192 and 196. A second O-ring 202 is mounted between plate 170 and casing 192. The second O-ring 200 shares a groove formed partly in each of these parts. Having shared grooves for supporting the O-rings allows for better sealing and for some movement with respect to the sealed components, and provides for high strength retention to oppose the oscillating movements of the rods 56 and 58 since the O-ring is practically in pure shear.

Figure 17:
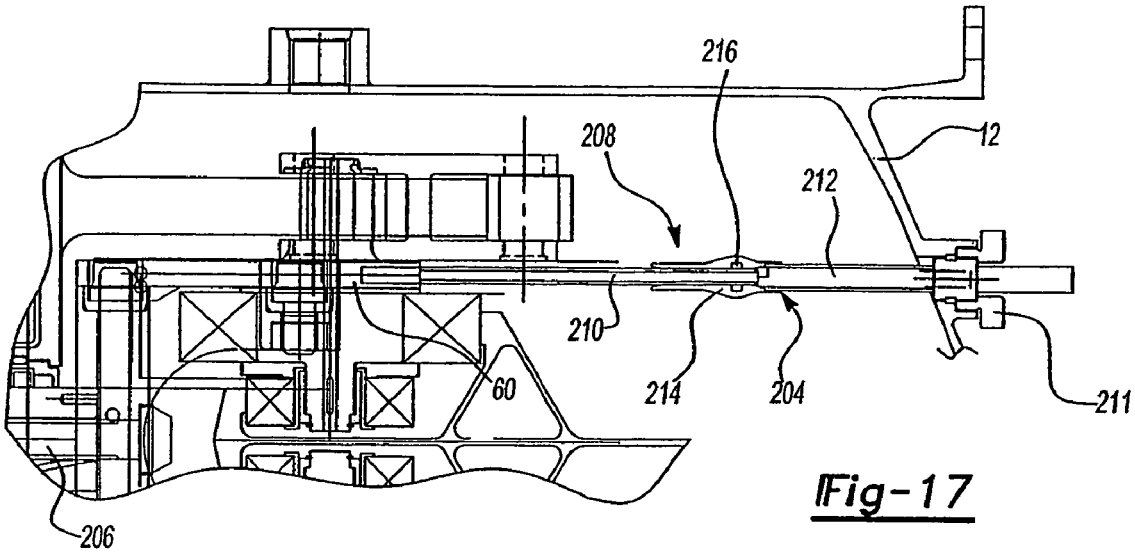
FIG. 17 is a partial cutaway view of the engine showing the R supply line connector.

With reference to FIG. 17, the air supply line 204 for feeding pressurized air to the ring 130 will be described. The air supply line 204 connects to the bearing pack 60. The pack 60 has internal channels which direct air to the connecting rods 56 and 58 which have a channel 206 for routing air to manifold 150. The line 204 has a connector 208 for connecting the bearing pack line 210 to the outer casing line 212. Outer casing line 212 is connected to casing 12 and to a supply of pressurized air. A standard connector 211 is used to connect line 212 to casing 12. The connector 208 has a long body with an O-ring cavity 216. The long body facilitates sealing because a long tube in a long hole minimizes leakage. The use of an O-ring further reduces leakage. As a result, the connector 208 seals against leakage while simultaneously allowing tube 210 to move or reciprocate with respect to tube 212 as a result of movement in the bearing pack 60.

Figure 18:
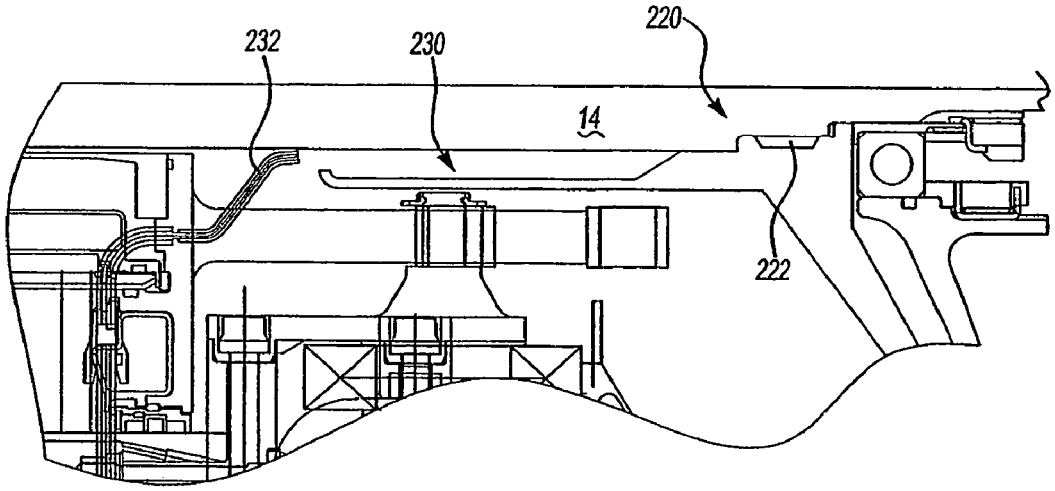
FIG. 18 is a partial cutaway view of the present invention showing the oil slinger of the present invention.

With reference to FIG. 18, the connection between the cams 46 and 48 and the output or rotary shaft 14 is illustrated at 220. In the disclosed embodiment, the connection at 220 is through gear teeth 222 on both the cam and shaft. Additionally, the oil slinger 230 is illustrated in FIG. 18. The oil slinger 230 is preferably part of the cams 46 and 48. Slinger 230 extends along the rotary shaft 14. In the most preferred design, slinger 230 is a hollow tube with a plurality of openings which allow it to be slung out to lubricate the bearing packs 60. The holes face the bearing packs 60. Oil is fed to the slingers 230 through feed line 232. Tube 232 is connected to an oil reservoir and pump to direct oil to slinger 230.

With reference to FIG. 21, the shaft seal tube 234 of the present invention will be described. Shaft seal tube 234 is concentric with and receives the rotary shaft 14. The shaft seal tube 234 is connected between the end plates 170. The seal tube 234 is a cylinder with a flange 236 on both ends. The tube 234 is sealed with an O-ring 236 to each of the end plates 170. Tube 234 eliminates the need for a seal from the stationary endplate to the rotating rotary shaft 14. The seal tube 234 also provides support to the endplate 170 and adds stiffness. The end plates 170 are supported on the outside diameter by the center case 238 and the bearing case 240. The center case 238 and the bearing case 240 define the outer case assembly 12. The endplate 170 is supported on the inside diameter by the shaft seal tube 234. The loads from the pistons 38 and 40 are transmitted to the end plates 170. With the end plates 170 supported at the inside and outside diameters, the link mount points 180 and 182 deflections are minimized. The minimized deflection of the link mount points 180 and 182 is important to maintain the straight line motion of the bearing packs 60 attached to the pistons 38 and 40.

Although this invention has been shown and described with respect to detailed embodiments thereof, it will be appreciated and understood by those skilled in the art that various changes in form and detail thereof may be made without departing from the spirit and scope of the claimed invention.

What is claimed is:

1. An internal combustion engine, comprising:

an engine block having a pair of end portions;

at least two combustion cylinders disposed within the engine block, each combustion cylinder defining opposing end portions and having a piston reciprocally secured within each end portion of the cylinder, the pistons within each combustion cylinder defining a combustion chamber therebetween;

a piston rod extending from each of the pistons;

a bearing pack secured to each of the piston rods, each bearing pack comprising a power bearing and a retractor bearing, the power bearing and retractor bearing being substantially coaxial;

a rotatably mounted cam corresponding to each end portion of the engine, each cam defining a power track corresponding to the power bearing, and a return track corresponding to the return bearing; whereby reciprocating movement of the pistons rotates each cam; and a linkage comprising:

at least one bearing defining a central portion and a pair of opposing ends, the central portion of the bearing being mounted substantially coaxially with the bearings of the bearing pack; and a pair of links associated with each at least one bearing, each link defining a pair of ends, one end of each of the links being pivotally secured to one of the opposing ends of its associated bearing, and the other end of the link being pivotally secured to a fixed location within the engine.

2. The internal combustion engine according to claim 1, wherein the retractor bearing is biased towards the return track.

3. The internal combustion engine according to claim 2, wherein the retractor bearing is mounted on a spring structured to bias the retractor bearing towards the return track.

4. The internal combustion engine according to claim 1:

wherein the piston further comprises a high pressure side facing the combustion chamber and a low pressure side having the piston rod extending therefrom; and further comprising a piston ring defining a plurality of lift pockets, and a plurality of trenches defined between the lift pockets, the trenches being in communication with the low pressure side of the piston, the lift pockets being structured to direct an airflow to a location between the piston ring and a wall of the combustion cylinder, the trenches being structured to permit any blowby from the high pressure side of the piston to flow to the low pressure side of the piston while resisting the flow of blowby within the lift pockets.

5. An internal combustion engine, comprising:

an engine block having a pair of end portions;

at least two combustion cylinders disposed within the engine block, each combustion cylinder defining opposing end portions and having a piston reciprocally secured within each end portion of the cylinder, the pistons within each combustion cylinder defining a combustion chamber therebetween;

a piston rod extending from each of the pistons;

a bearing pack secured to each of the piston rods, each bearing pack comprising a power bearing and a retractor bearing, the power bearing and retractor bearing being substantially coaxial;

a rotatably mounted cam corresponding to each end portion of the engine, each cam defining a power track corresponding to the power bearing, and a return track corresponding to the return bearing; whereby reciprocating movement of the pistons rotates each cam; and wherein the retractor bearing is biased towards the return track.

6. The internal combustion engine according to claim 5, wherein the retractor bearing is mounted on a spring structured to bias the retractor bearing towards the return track.

7. An internal combustion engine, comprising:

an engine block having a pair of end portions;

at least two combustion cylinders disposed within the engine block, each combustion cylinder defining opposing end portions and having a piston reciprocally secured within each end portion of the cylinder, the pistons within each combustion cylinder defining a combustion chamber therebetween, each piston having a high pressure side facing the combustion chamber and a low pressure side, each piston further having a piston ring defining a plurality of lift pockets, and a plurality of trenches defined between the lift pockets, the trenches being in communication with the low pressure side of the piston, the lift pockets being structured to direct an airflow to a location between the piston ring and a wall of the combustion cylinder, the trenches being structured to permit any blowby from the high pressure side of the piston to flow to the low pressure side of the piston while resisting the flow of blowby within the lift pockets;

a piston rod extending from the low pressure side of each of the pistons;

a bearing pack secured to each of the piston rods, each bearing pack comprising a power bearing and a retractor bearing, the power bearing and retractor bearing being substantially coaxial; and a rotatably mounted cam corresponding to each end portion of the engine, each cam defining a power track corresponding to the power bearing, and a return track corresponding to the return bearing; whereby reciprocating movement of the pistons rotates each cam.

* * * * *